United States Patent [19]

MacDonald

[11] Patent Number: 4,775,089

[45] Date of Patent: Oct. 4, 1988

[54] IMPACT NAILING AND DIMPLING APPARATUS

[76] Inventor: Donald K. MacDonald, 1180 Kilkare Rd., Sunol, Calif. 94586

[21] Appl. No.: 61,432

[22] Filed: Jun. 12, 1987

[51] Int. Cl.[4] ..... B25C 1/04; B25C 3/00

[52] U.S. Cl. ..... 227/2; 227/66; 227/116; 227/120; 227/136

[58] Field of Search ..... 91/267, 271; 173/139; 227/2, 7, 8, 66, 93, 94, 95, 116, 117, 120, 130, 135, 136, 132

[56] References Cited

U.S. PATENT DOCUMENTS

| | | | |
|---|---|---|---|
| 1,161,033 | 11/1915 | Craig | 227/66 X |
| 2,442,949 | 6/1948 | Fischer | 227/66 X |
| 2,857,596 | 10/1958 | Allen et al. . | |
| 2,887,686 | 5/1959 | Wandel et al. . | |
| 2,918,675 | 12/1959 | Smith | 227/66 |
| 3,027,560 | 4/1962 | Nelson | 227/66 |
| 3,040,327 | 6/1962 | Michel | 227/66 X |
| 3,203,610 | 6/1965 | Farrell . | |
| 3,212,633 | 10/1965 | Dickson . | |
| 3,374,934 | 3/1968 | Dickson . | |
| 3,602,097 | 8/1971 | Dowdall | 91/267 |
| 3,638,532 | 2/1972 | Novak | 91/300 X |
| 3,640,655 | 2/1972 | Wallace | 425/109 |
| 3,685,396 | 8/1972 | Obergfell | 91/417 A X |
| 3,711,008 | 1/1973 | Clifford et al. | 227/147 |
| 3,774,293 | 11/1973 | Golsch | 227/66 X |
| 3,971,116 | 7/1976 | Goodsmith et al. . | |
| 4,091,981 | 5/1978 | Moriguchi et al. . | |
| 4,341,336 | 7/1982 | Smith | 227/66 |
| 4,566,619 | 1/1986 | Kleinholz | 227/8 |
| 4,610,381 | 9/1986 | Kramer | 227/7 |
| 4,666,074 | 5/1987 | MacDonald | 227/66 |

*Primary Examiner*—Paul A. Bell

*Attorney, Agent, or Firm*—Fliesler, Dubb, Meyer & Lovejoy

[57] ABSTRACT

An impact nailing and dimpling apparatus is described. In the apparatus there is provided a dimple forming member and a number of valve members for causing the dimple forming member to be repetitively hammered for providing a dimple in a wallboard or other surface and for setting a nail in the dimple. An adjustable nut is provided for shutting off the apparatus when the dimple and nail have been set to a predetermined depth. A nail feed mechanism automatically feeds nails from a cartridge to a position located beneath the dimple forming member. The baseplate is provided with recesses coupled to a source of vacuum for providing a negative pressure between the base and the wallboard or other surface against which the apparatus is held during nailing operations.

21 Claims, 40 Drawing Sheets

FIG. 13B
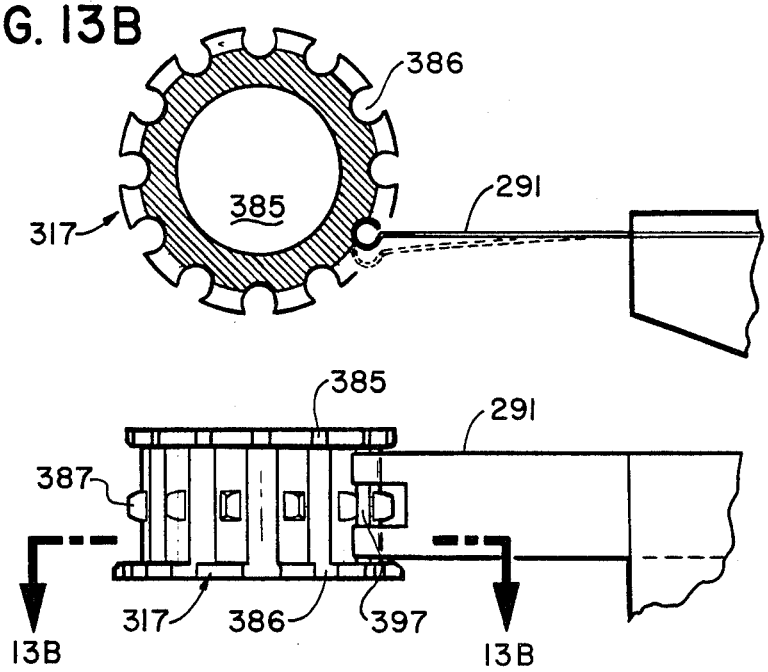
FIG. 13A
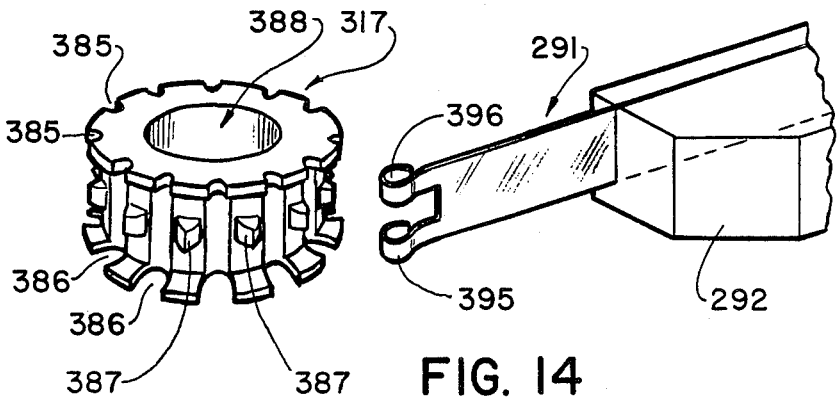
FIG. 14

IMPACT NAILING AND DIMPLING APPARATUS

BACKGROUND OF THE INVENTION

1. Field of the Invention

The present invention relates to apparatus used for installing construction materials in general and to an automatic impact nailing and dimpling apparatus for driving a nail and setting a dimple to a predetermined depth in gypsum wallboard in particular.

2. Description of Prior Art

Gypsum board, also called wallboard and drywall, comprises processed gypsum which is sandwiched between sheets of paper. The board is usually provided in standard sheets 4 feet wide by 8 to 14 feet in length, ¼ to 1' thickness.

In many applications, such as in the construction of residential wood framed homes, the board is attached to wooden studs by nailing the board to the studs. The nails used typically comprise a cupped head. As each nail is driven through the wallboard and into the stud, it is countersunk in the wallboard. In the process of countersinking the nail in the wallboard, a dimple is formed in the wallboard. The dimples thus formed and butt joints between adjacent boards are then taped and covered with a wallboard compound for providing a smooth uniform surface. Thereafter the surface is painted or covered with a plaster for providing an attractive and aesthetically pleasing appearance.

In the past, the nailing of wallboard to a wooden stud has been done using a conventional wallboard hammer, a single-stroke or reciprocating automatic impact hammer or the like.

In using a wallboard hammer, a nail is hammered into the wallboard and the stud until the base of the head of the nail is flush with the surface of the wallboard. Thereafter, a single stroke of the hammer using the convex surface of the hammer countersinks the nail and at the same time forms a dimple in the wallboard.

A principal disadvantage of the above-described method for installing wallboard is that the head of the nail is struck by the convex surface of the hammer before the convex surface of the hammer contacts the surface of the wallboard. This tends to cause the head of the nail to pierce the paper covering of the wallboard. Also, with hand nailing there is no way to control the depth of the nail set and dimple. The hammer head, therefore, tends to shatter the gypsum core. Also, if the nail is not driven perpendicular to the wallboard, the sharp edge of the head of the nail will tend to pierce the paper covering the wallboard. Once the surface paper covering is pierced, it loses its integrity which reduces the holding ability of the cup headed nail.

Another disadvantage of the above-described method for installing wallboard is that it is time consuming.

Still another disadvantage of the above-described method is that it is difficult to set nails and dimples repeatedly at uniform and preferred depths.

In typical prior known single-stroke and certain reciprocating-type automatic impact nailer and dimpler apparatus, such as disclosed in U.S. Pat. No. 4,610,381 issued to Francis J. Kramer, et al., there is provided a piston member and nail set assembly which is pneumatically driven in a single-stroke or reciprocating fashion, a nail feeding mechanism which automatically feeds nails to a position beneath the nail set, a dimpler having a convex exterior surface with a hole centrally located therein which is activated by the piston member for creating a dimple in the wallboard as the nail is being set, and a triggering mechanism to control the operation of the apparatus.

In operation, the nail is driven through the hole in the dimpler by the piston and when the piston strikes the dimpler, it causes the dimpler to dimple the wallboard.

A principal disadvantage of the above-described single-stroke and reciprocating automatic-type nailing and dimpling apparatus is that, in general, there is no means provided in the apparatus for automatically controlling the depth to which a nail and a dimple is set in the wallboard. As a consequence, if the air pressure in the apparatus varies or the hardness of the wood studs to which the wallboard is nailed varies, the depth to which each of the nails is driven cannot be accurately controlled. This may result in nails not being driven deep enough or driven too deeply. If the nails are not driven deep enough, they will not be properly countersunk and if the dimpler is not driven deep enough, the paper will not be properly dimpled. Alternatively, if the nails and dimpler are driven too deep this can cause the nails and/or the dimpler to tear the surface paper, causing the nails to lose their holding ability.

Another disadvantage of the above-described prior known single-stroke and reciprocating-type automatic nailing and dimpling apparatus is that in such apparatus there is generally no means, such as a sole plate or housing, for insuring that a nail is hammered into the wallboard perpendicular to the wallboard. This often results in a sharp edge of the nail pressing into the paper covering of the wallboard resulting in a greater tendency for the nail to cut through the paper covering of the wallboard as described above.

In applicant's U.S. Pat. No. 4,666,074, issued May 19, 1987, there is disclosed a reciprocating-type automatic impact nailing and dimpling apparatus comprising a sole plate and means for automatically setting a nail or other fastener and a dimple to a predetermined depth in a gypsum wallboard or other substrate. The sole plate insures that the fastener is set perpendicular to the wallboard.

In applicant's patented apparatus there is provided a movable dimpler and a separately movable hammer assembly comprising a movable piston and a nailset which are movably mounted in a housing of the apparatus. Located in a compressed air channel in the apparatus between a source of compressed air, the dimpler and the hammer assembly, there is provided a compressed air control valve. The valve is provided for controlling a flow of compressed air from the source to the dimpler and the hammer assembly including the piston. Extending from the dimpler to the valve is a valve control member for controlling the operation of the valve.

In operation, the apparatus is first connected to a source of compressed air which causes the dimpler and hammer assembly to be automatically retracted into the housing. A nail is then inserted beneath the nailset within the interior of the dimpler over a hole in the dimpler. The sole plate is then placed in contact with a wallboard. The activation of a trigger member then causes the compressed air control valve to be moved to a first position wherein the dimpler and hammer assembly are freed to move and compressed air is channeled to the piston causing the piston to reciprocate and drive the nail through the hole in the dimpler and into the wallboard. Thereafter, the hammer assembly contacts and moves the dimpler. When the dimpler has been moved a predetermined distance relative to the housing, the valve control member extending from the dimpler causes the valve to be moved from its first position to a second position wherein the valve interrupts the flow of compressed air to the piston thereby automatically stopping the reciprocal movement of the piston and further movement of the dimpler into the wallboard. By adjusting the length of the valve control member, the depth of the dimple is controlled. By adjusting the length of the nailset, the depth of the nail relative to the dimple is controlled.

SUMMARY OF THE INVENTION

In view of the foregoing, there is provided in accordance with the present invention embodiments of a reciprocating-type nailer and dimpling apparatus comprising a number of unique features. The features include an improved integrated hammer and dimpler assembly, an improved manually adjustable control valve assembly, an improved automatic nail feed assembly, an improved nail cartridge and an improved vacuum sole plate.

In the integrated hammer and dimpler assembly there is provided a means for providing a dimple attached to one end thereof and a reciprocal piston means movably located in the interior thereof.

In the manually adjustable control valve assembly there is provided an adjustable nut which is threaded onto a depth control rod. The nut is positioned to be contacted by the movable hammer assembly when the hammer assembly is moved a predetermined distance corresponding to a predetermined dimple depth by the reciprocating piston.

In operation, as the hammer assembly is moved by the piston means during the setting of a nail and dimple in a wallboard, the hammer assembly contacts the adjustable nut. Further movement of the hammer assembly moves the nut and the depth control rod, shutting of the air supply to the piston means in the hammer assembly. The depth to which the nail and dimple is set in the wallboard is controlled by manually adjusting the position of the nut on the depth control rod.

In the automatic nail feed assembly there is provided a toothed sprocket and a pair of upper and lower nail feed arms.

In operation, a tape of nails is pulled from the nail cartridge by the toothed sprocket. As each nail reaches a predetermined position on the sprocket, the upper and lower nail feed arms passing above and below the sprocket through slots provided therefor in the sprocket shaft, respectively, engage the nail, remove it from the tape and position it to be engaged by the dimpler on the hammer assembly. Thereafter, the nail feed assembly is retracted and the sprocket advanced to prepare for another cycle of operation.

In the improved nail cartridge, nails are held therein by means of a paper tape. A pair of spaced slots are provided at spaced locations along the tape for holding the nails. Holes to be engaged by the teeth on the sprocket are positioned between the nails. An important feature of the tape is that the tape comprises the same material that is used for taping the wallboard after it is installed. As a consequence, the cartridges are relatively inexpensive to manufacture and tape fragments which may be generated and adhere to the wallboard during installation will not adversely affect the subsequent taping of the wallboard.

In the improved vacuum sole plate, one or more recesses are provided in the sole plate with a seal for providing a vacuum-tight seal between the sole plate and the wallboard against which the sole plate is placed. A source of vacuum is coupled to the recesses for providing the vacuum therein.

By means of the foregoing described features of the present invention, the nailing and dimpling of gypsum wallboard to wooden studs is rendered uniform and repeatable regardless of variations in the density of the wooden studs and in the thickness of the wallboard being attached to the stud. Furthermore, by means of the above-described feature, the uniform and repeatable nailing and dimpling of the wallboard to wooden studs can be achieved even by relatively inexperienced persons.

BRIEF DESCRIPTION OF THE DRAWING

The above and other objects, features and advantages of the present invention will become apparent from the following detailed description of the accompanying drawing in which:

FIG. 13A is a side elevation view of a sprocket according to the present invention;

FIG. 13B is a cross-sectional view taken in the direction of lines 13B—13B of FIG. 13A;

FIG. 14 is a perspective view of a part of the sprocket assembly according to the present invention;

DESCRIPTION OF THE PREFERRED EMBODIMENTS

Figure 1:
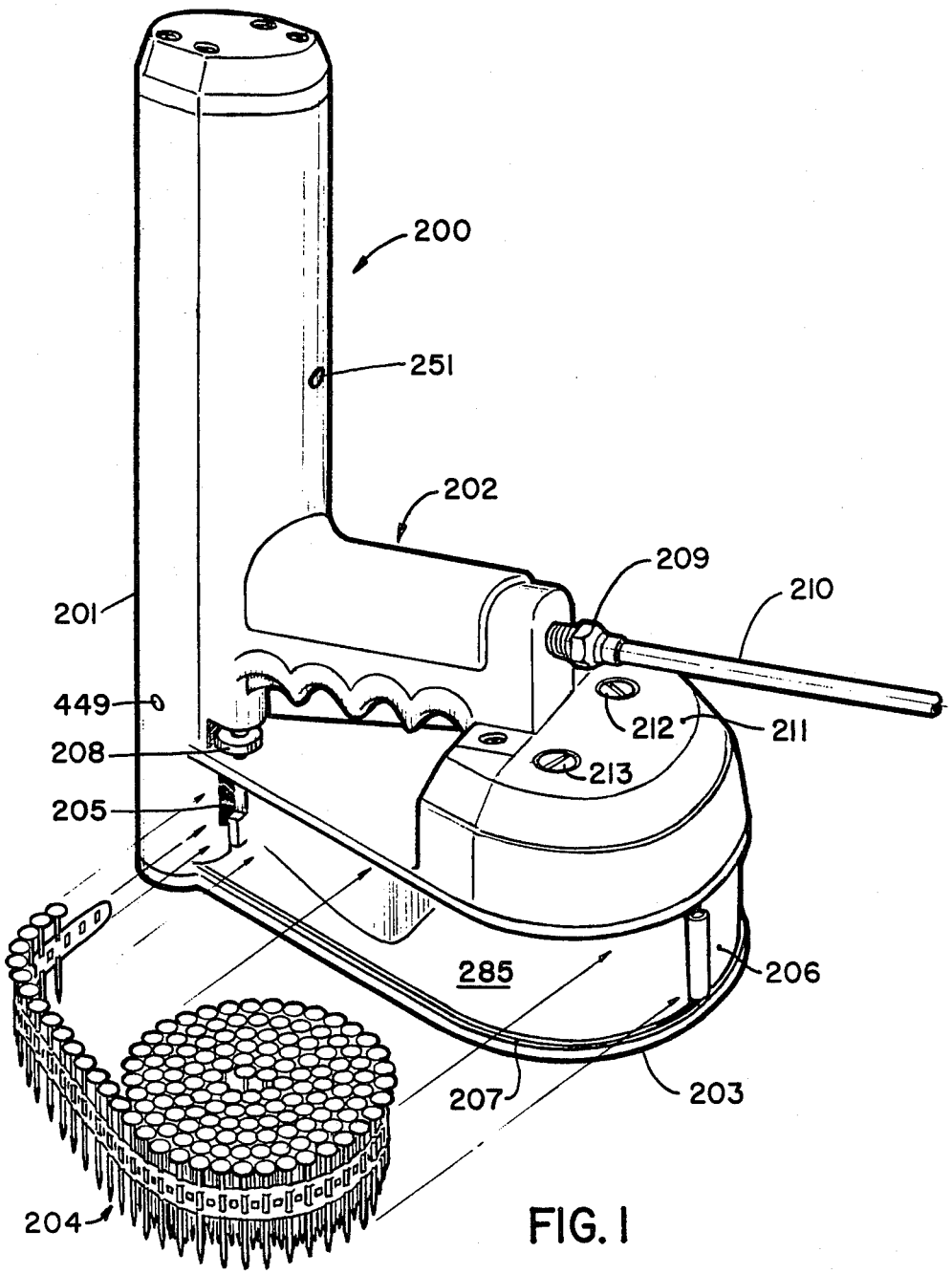
FIG. 1 is a perspective view of a dimpling and nailing apparatus according to the present invention.

Referring to FIG. 1, there is provided in accordance with the present invention a pneumatic nailing and dimpling apparatus designated generally as 200. In the apparatus 200 there is provided an elongated generally cylindrical hammering section 201, a handle section 202 and a nail cartridge receiving section 203. Section 203 is provided for receiving a cartridge of nails designated generally as 204.

At the lower end of the hammering section 201 and forward of the nail cartridge receiving section 203 there is provided a T-shaped shouldered nail passageway 205. Passageway 205 is provided for the insertion of nails from the cartridge 204 into the lower end of the hammering section 201, as will be further described in detail below.

In the nail cartridge receiving section 203 there is provided a nail cartridge receiving section door 206. Door 206 is provided to slide in a pair of upper and lower recesses 207 (only the lower one of which is shown in FIG. 1). Below the forward end of the handle section 202 there is provided a dimple depth control adjusting nut 208. At the rear end of the handle section 202 there is provided a fitting 209. Fitting 209 is provided for coupling the apparatus 200 to a source of compressed air by means of an air line 210. In a top surface 211 of the nail cartridge-receiving section 203 there is provided a pair of adjusting screws 212 and 213. Screw 212 is used for adjusting the pressure of the incoming air from the line 210 by a regulator, not shown. Screw 213 is used for adjusting the pressure of the air to the top of the hammering section 201, as will be further described below.

Figure 3:
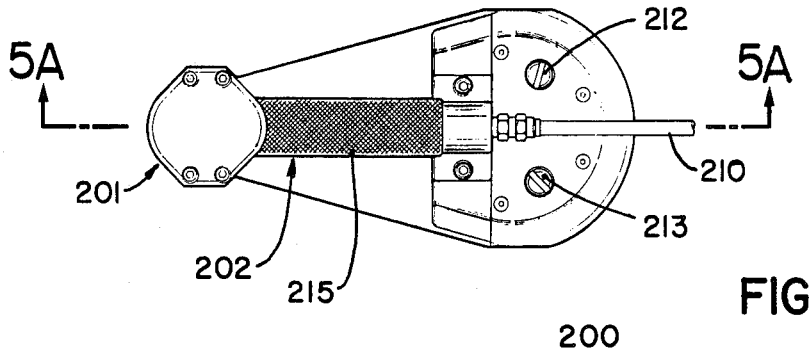
FIG. 3 is a top plan view of FIG. 2.
Figure 2:
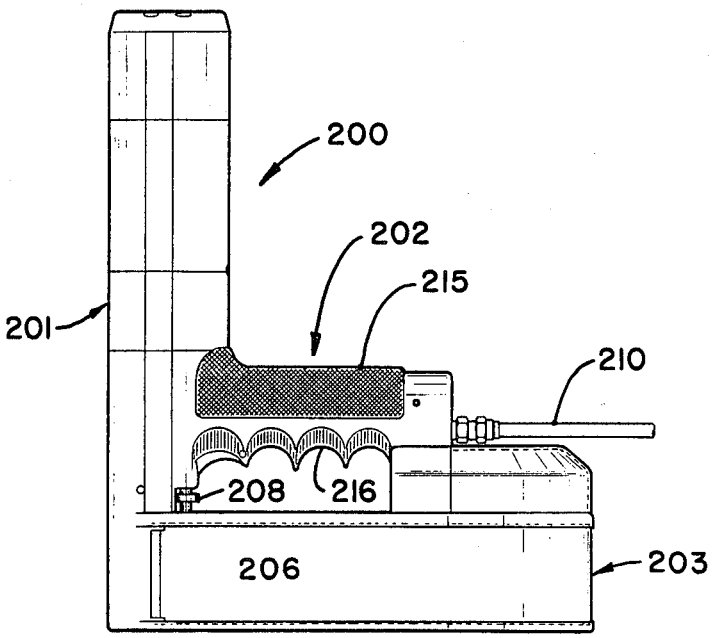
FIG. 2 is a side elevation view of the apparatus of FIG. 1.

Referring to FIGS. 2 and 3, the handle section 202 is provided with an upper knurled palm-supporting surface 215 and a plurality of curved finger receiving surfaces 216. The surfaces 215 and 216 are provided for securely gripping the apparatus 200.

Figure 4:
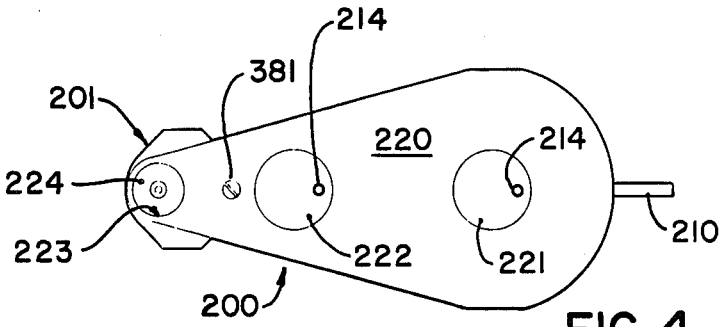
FIG. 4 is a bottom plan view of FIG. 2.

Referring to FIG. 4, the apparatus 200 is provided with a flat base 220. In the base 220 there is provided a pair of circular cavities 221 and 222. Cavities 221 and 222, as will be further described below, are provided with pair of holes 214 coupled to a vacuum pump for creating a negative pressure or vacuum between the base 220 and wallboard or other material against which the apparatus 200 is pressed. At the forward or left end of the base 220 there is provided a circular opening 223. Opening 223 is provided for allowing a dimple forming member 224 to pass therethrough.

Figure 5A:
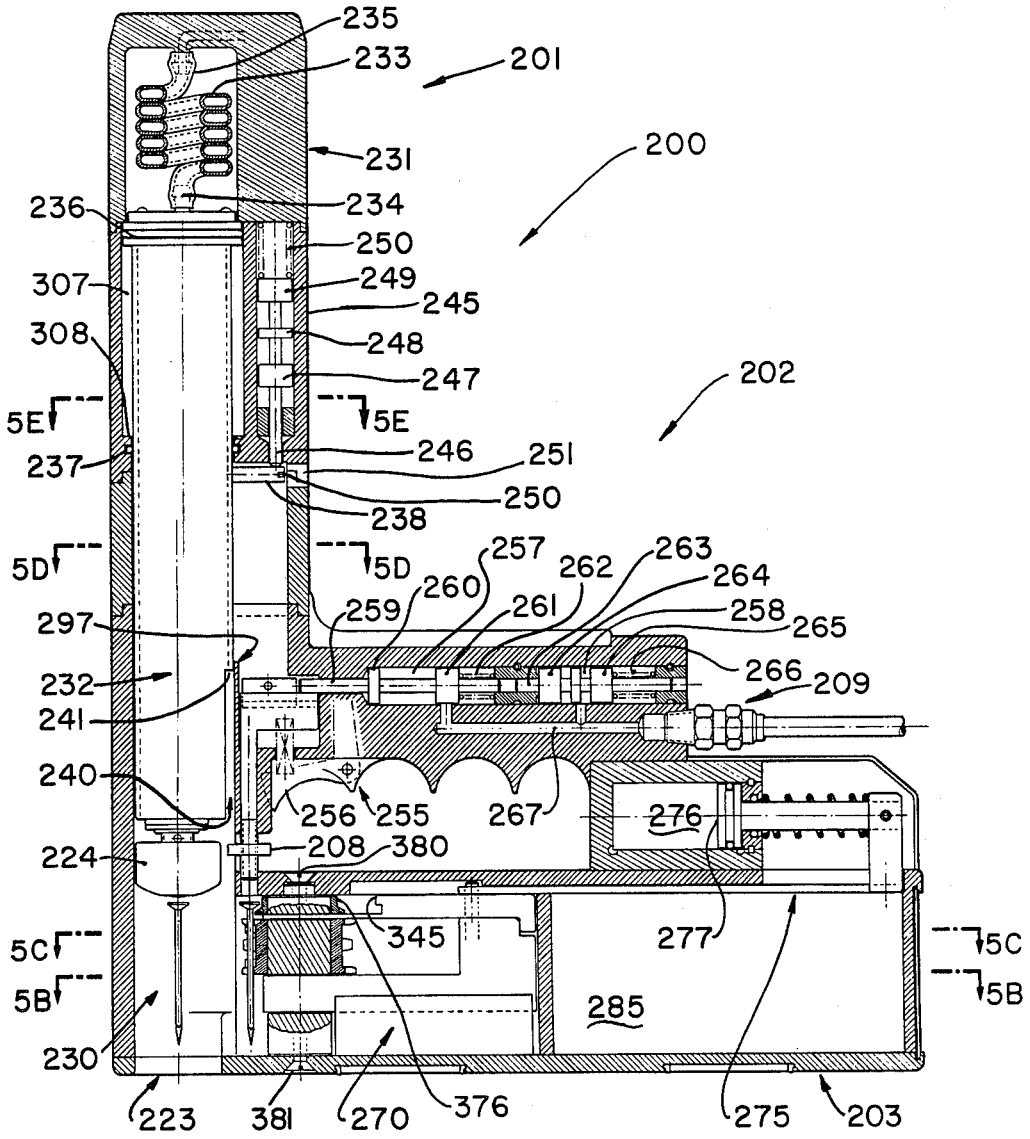
FIGS. 5A is a cross-sectional view taken along lines 5A—5A of FIG. 3.

Referring to FIG. 5A, there is provided in the interior of the hammering section 201 an elongated cylindrical cavity 230. The circular opening 223 which is provided for the dimple forming member 224 is located at the lower end of the cavity 230. The cavity 230 extends from the circular opening 223 to the top of the hammering section 201. For convenience, the top of the hammering section 201 is designated 231. Within the cylindrical cavity 230 there is provided a cylindrical hammer assembly 232. The dimple forming member 224 is attached to the lower end of the hammer assembly 232. At the upper end of the hammer assembly 232, the hammer assembly 232 is coupled to a flexible air hose 233. The air hose 233 is coupled to the hammer assembly 232 by means of a fitting 234 and to a source of compressed air, as will be further described below, by means of a fitting 235.

In the upper end of the hammer assembly 232 there is a provided an O-ring 236. O-ring 236 is provided for forming a seal between the upper end of the assembly 232 and the cylindrical side walls of the cavity 230. Another O-ring 237 is provided in the wall forming the cavity 230 below the O-ring 236 for providing a seal between the hammer assembly 232 and the side wall of the cavity 230. Immediately below the O-ring 237 and extending outwardly from the hammer assembly 232 there is provided a valve actuating pin 238. A rectangularly shaped cavity 239 is provided below the pin 238 for providing clearance for the pin 238. At its lower end, the wall of the hammer assembly 232 is cut away providing a recessed portion 240. At the upper end of the recessed portion 240 there is provided a shoulder 241. As will be further described below, the shoulder 241 contacts the upper left edge of the adjusting nut 208 when the hammer assembly 232 is driven downwardly for automatically turning off the apparatus 200 when a selected dimple depth is achieved.

Above the valve actuating pin 238 there is provided a switching valve assembly 245. The valve assembly 245 is provided with a valve stem 246, a plurality of sealing members 247, 248 and 249 and a spring 250. The spring 250 is provided for urging the valve assembly 245 to its lowest position when the valve actuating pin 238 is moved downwardly, as will be further described below. In the end of the valve actuating pin 238 there is further provided a slot 250. The slot 250 is accessible through a hole 251 provided there for in the wall of the hammering section 201 to facilitate removal of the pin 238 as may be required during repair or replacement of parts in the hammering section 201.

In the forward or left end of the handle section 202 there is provided a valve actuating trigger assembly 255. In the trigger assembly 255 there is provided a trigger member 256. When depressed, the trigger member 256 actuates a pair of valve assemblies 257 and 258. In the valve assembly 257 there is provided a valve stem 259 and a pair of sealing members 260 and 261 and a spring 262. In the valve assembly 258 there is provided a valve stem 263, a pair of sealing members 264 and 265 and a spring 266. The valve assemblies 257 and 258 control the flow of air into the nailing apparatus 200 via an air passageway 267 coupled to the fitting 209.

In the forward end of the nail cartridge receiving section 203 there provided a nail feed assembly 270. As will be further described below, nail feed assembly 270 removes nails from the cartridge 204 and injects them into a space provided therefor in the lower end of the cavity 230 below the dimple forming member 224 of the hammer assembly 232.

Below the fitting 209 there is provided a nail feed piston assembly 275. In the piston assembly 275 there is provided a cylindrical piston cavity 276, a piston 277, a spring member 278 and an actuating linkage 279. The linkage 279 is provided for coupling the piston 277 to the nail feed assembly 270 for operating the assembly 270, as will be further described below.

Figure 5B:
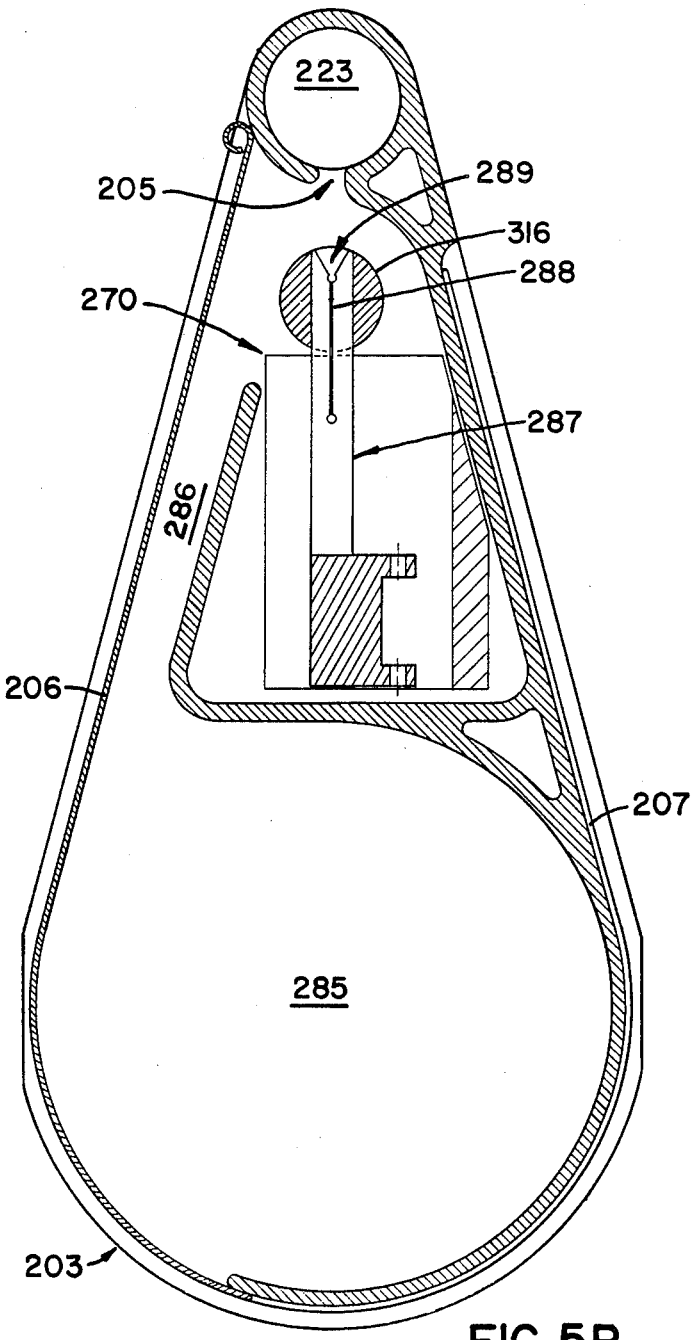
FIG. 5B is a cross-sectional view taken in the direction of lines 5B—5B of FIG. 5A.

Referring to FIG. 5B, there is provided in the nail cartridge receiving section 203 a circular nail cartridge receiving chamber 285 and a nail passageway 286. The passageway 286 is provided for feeding the nails in front of the nail feed assembly 270 for injection through the hole 205 to a point centrally located below the dimple forming member 224. As will be further described below, the nail feed assembly 270 is provided with a lower nail feed arm 287. The feed arm 287 is an elongated generally rectangular member which is forked at the forward end thereof by means of a slot 288 provided in the center thereof. The extreme forward end of the arm 287 is provided with a triangularly shaped opening 289. The opening 289 is provided for receiving nails from the cartridge 204.

Figure 5C:
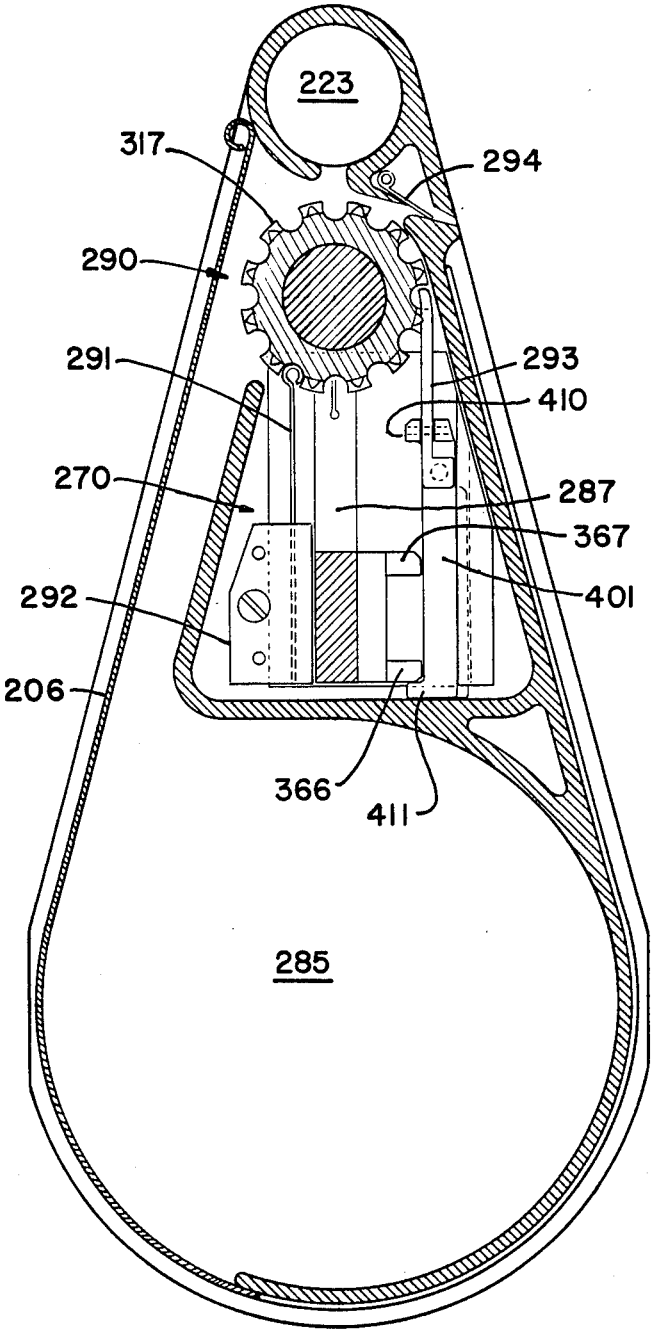
FIG. 5C is a cross-sectional view taken in the direction of lines 5C—5C of FIG. 5A.

Referring to FIG. 5C, there is further provided in the nail feed assembly 270 a sprocket assembly 279, an elongated sprocket anti-backup member 291 which extends in a cantilever fashion from a supporting block 292 and a sprocket-advancing assembly 293. Forward of the sprocket assembly 290 there is provided an anti-backup member 294 for preventing the tape in the nail cartridge 204 from backing up when the nails are removed therefrom.

Figure 5D:
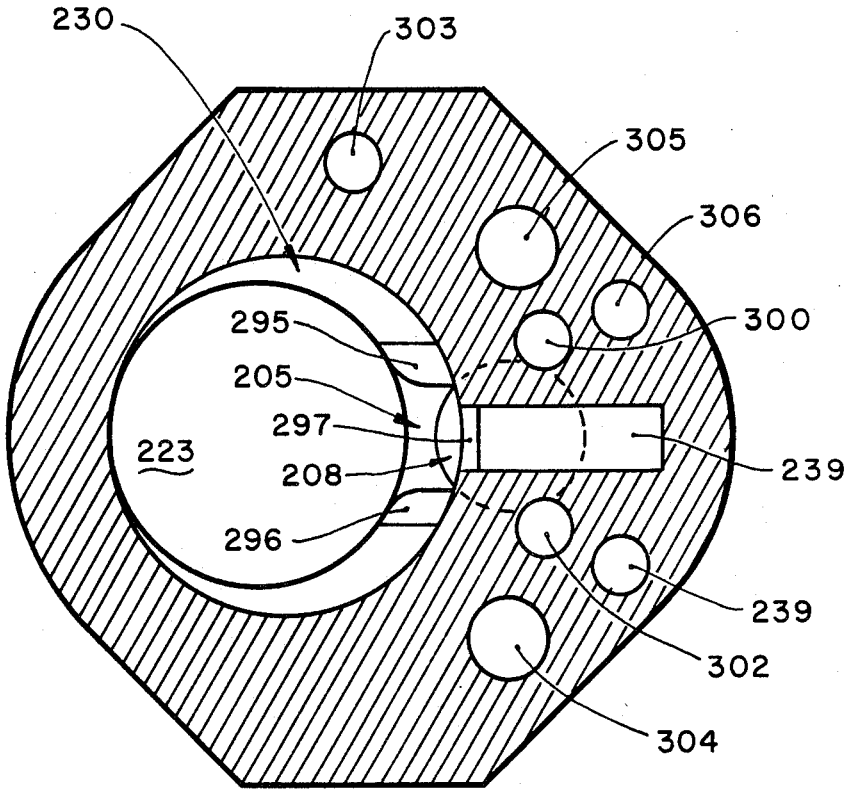
FIG. 5D is a cross-sectional view taken in the direction of lines 5D—5D of FIG. 5A.

Referring to FIG. 5D, there is shown in a cross-section of the hammering section 201 an internal view of the opening 223 in the base 220 through which the dimple forming member 224 passes. To the right of the opening 223 there is shown a top plan view of the opening 205 through which a nail from the cartridge 204 passes as it is injected into the cavity 230 below the dimple forming member 224. The upper end of the hole 205 is enlarged forming a pair of shoulders 295 and 296 for the purpose of providing a clearance for the head of the nails passing therethrough. To the right of the hole 205 there is shown in solid and phantom lines a top view of the dimple depth adjusting nut 208. To the right of the solid lines illustrating the nut 208 there is shown a rectangular portion 297 of the upper end of an interior wall which forms part of the cavity 230 above the adjusting nut 208, as shown more clearly in profile in FIG. 5A. To the right of the portion 297 there is shown a plan view of the rectangularly shaped cavity 239 in which the valve actuating pin 238 moves as the hammer assembly 232 is moved up and down.

On opposite sides of the rectangular cavity 239 there is provided a plurality of air passageways 300–306. The air passageways 300–306, as will be explained in detail below, are used for operating the apparatus 200.

Figure 5E:
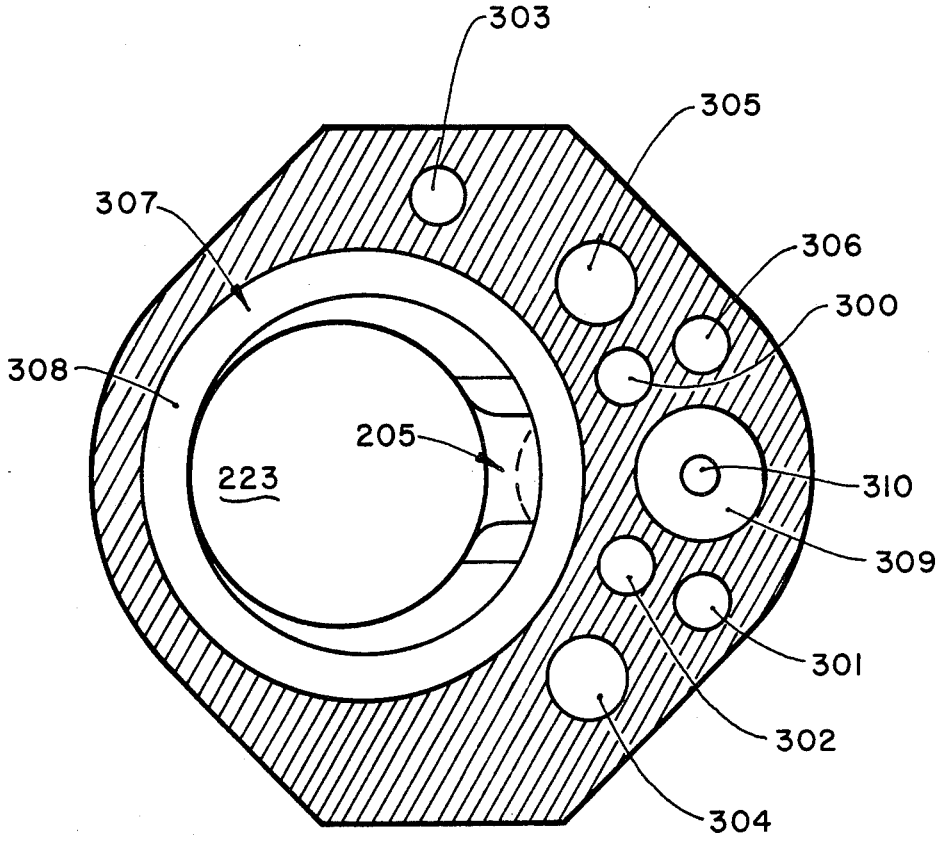
FIG. 5E is a cross-sectional view taken in the direction of lines 5E—5E of FIG. 5A.

Referring to FIG. 5E, there is shown in another cross-section of the hammering section 201 an internal view of the opening 223. Outside of the opening 223 there is shown an enlarged section 307 of the cavity 230. The lower end of the section 307 comprises a shoulder 308, as shown more clearly in profile in FIG. 5A. Midway between the holes 300-306 there is shown a cylindrical cavity 309 having a hole 310 located in the bottom center portion thereof. The cavity 309 is provided for containing the switching valve assembly 245. The hole 310 is provided for receiving the valve stem 246.

Figure 6:
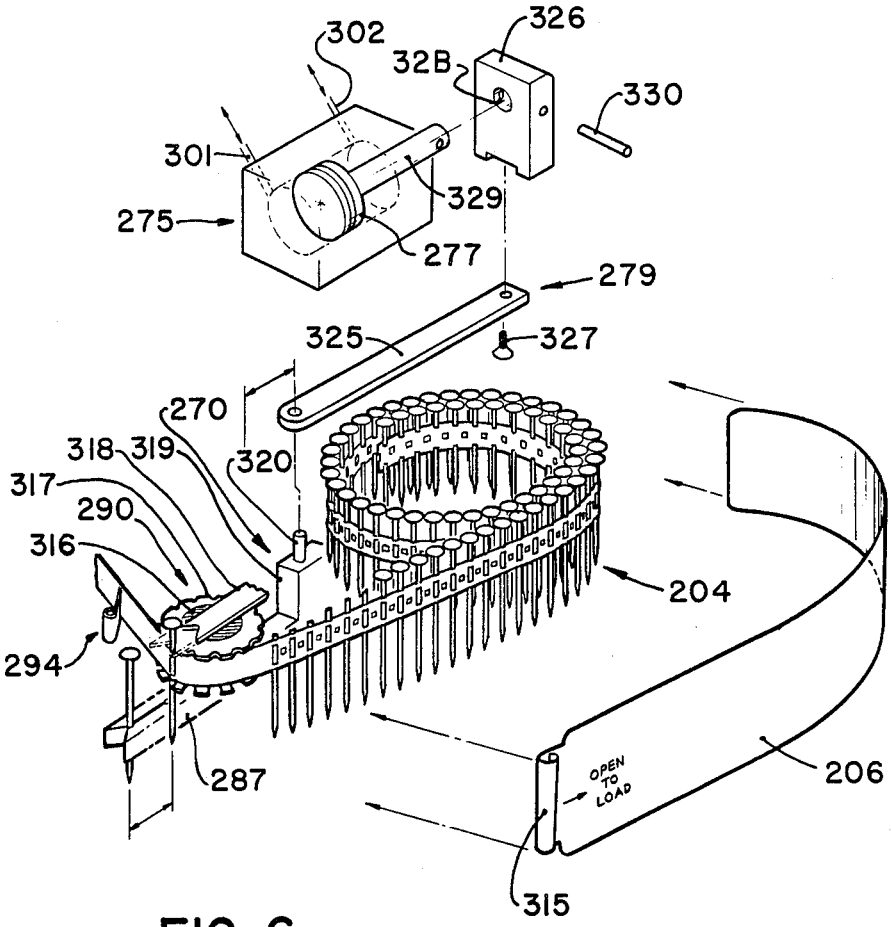
FIG. 6 is an exploded view of the nail cartridge and a portion of the nail feed assembly of the present invention.

Referring to FIG. 6, there is shown in an exploded perspective view the nail cartridge receiving compartment door 206, the nail cartridge 204, the sprocket assembly 290, the anti-backup member 294, the lower nail feed arm 287 in the nail feed assembly 270, the nail feed assembly actuating linkage 279 and the nail feed piston assembly 275.

In the door 206 there is provided a finger grip 315. The finger grip 315 is provided for facilitating the sliding of the door 206 in the nail cartridge chamber door recesses 207.

In the sprocket assembly 290 there is provided a cylindrical sprocket shaft 316, shown in plan view in FIG. 5B, and a toothed sprocket 317, shown in plan view in FIG. 5C. The toothed sprocket 317 is provided for rotating about the sprocket shaft 316. Mounted above the sprocket assembly 290 there is provided in the nail feed assembly 270 an upper nail feed arm 318. At the rear end of the lower nail feed arm 287 there is provided a raised block member 319. Extending perpendicularly from the block member 319 there is provided a pin 320.

In the actuating linkage 279 there is provided a linkage rod 325. The forward end of the linkage rod 325 is fitted to the pin 320. The opposite end of the rod 325 is screwed to a block member 326 by means of a screw 327. In the block member 326 there is provided a hole 328 in which is mounted a valve stem 329 extending from the piston 277 of the nail feed piston assembly 325. The stem 329 is mounted in the hole 328 by means of a pin 330.

Referring to FIGS. 7–11, there is provided in the forward end of the lower nail feed arm 287 a magnet 335 for holding a nail in a hole 336 provided therefor at the forward end of the slot 288. The diameter of the hole 336 is typically slightly smaller than the diameter of the nails. Also used therewith, the slot 288 is provided for allowing the forward end of the arm 287 to spring open and closed as a nail is captured in the hole 336. At the forward end of the upper nail feed arm 318 there is provided a V-shaped slot 340. Slot 340 is provided for engaging the upper part of a nail below the head thereof.

The upper nail feed arm 318 extends in a cantilever fashion from an elongated rectangular supporting member 341. Centrally located in the member 341 is an elongated slot 342 which is provided for freely receiving the pin 320 on the raised block member 319. Slot 342 is also provided for allowing the member 319 to continue to move the forward end of the lower arm 287 beneath the dimple forming member 224 after the forward motion of the upper arm 318 is halted during the injection of a nail into the cavity 230, as will be further described below. The pin 320 extends above the upper surface of the slot 342. At the rear end of the supporting member 341 there is provided a downwardly extending projection 343. Projection 343 is adapted to fit on a shouldered portion 339 at the rear end of the raised block member 319 for engaging and retracting the upper arm 318 during the retraction of the nail feed assembly 270.

In a hole provided therefor in the rear end of the supporting member 341, there is provided a spring member 344. Spring 344 is provided for biasing the upper arm 318 forwardly against the pin 320. At the forward end of the supporting member 341 above the rear end of the upper nail feed arm 318 there is provided a forwardly extending projection 345. Projection 345 engages the sprocket assembly 290 for halting the forward motion of the upper arm 318 during the forward motion of the assembly 270. Pivotally attached to the base of the raised block member 319 there is provided a cam member 346.

In operation, the cam member 346 is caused to bear against cam surfaces 347 and 348 on an upstanding section 349 of an L-shaped nail feed assembly base member 350. Below the upstanding section 349 there is provided in the base member 350 an elongated slot 351. Extending perpendicular from the upstanding section 349 there is provided in the base member 350 a horizontal section 352. Located in the horizontal section 352 there is provided a second slot 353. Slot 353 is provided for receiving the raised block member 319 and the lower nail feed arm 287 extending therefrom.

Figure 8:
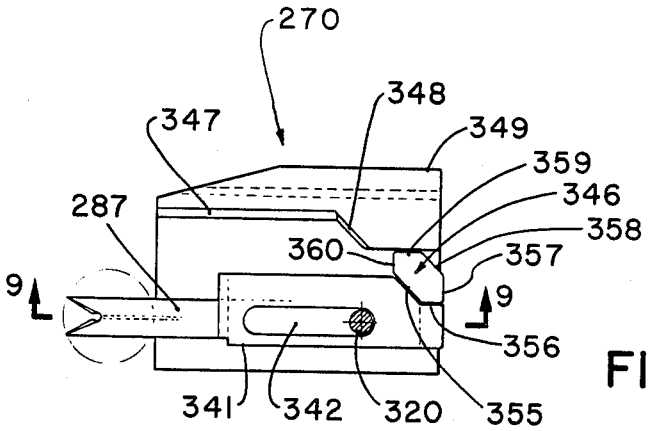
FIG. 8 is a top plan view of a portion of the nail feed assembly according to the present invention.
Figure 9:
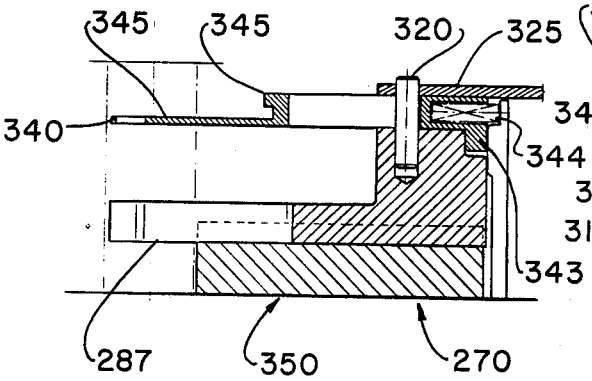
FIG. 9 is a cross-sectional view taken in the direction of lines 9—9 of FIG. 8.

As shown more clearly in FIG. 8, there is provided in the cam member 346 a plurality of cam surfaces 355–360. The surfaces 355 and 356 bear against the supporting member 341 and the surfaces 358 and 359 bear against the surfaces 348 and 347, respectively.

Figure 11:
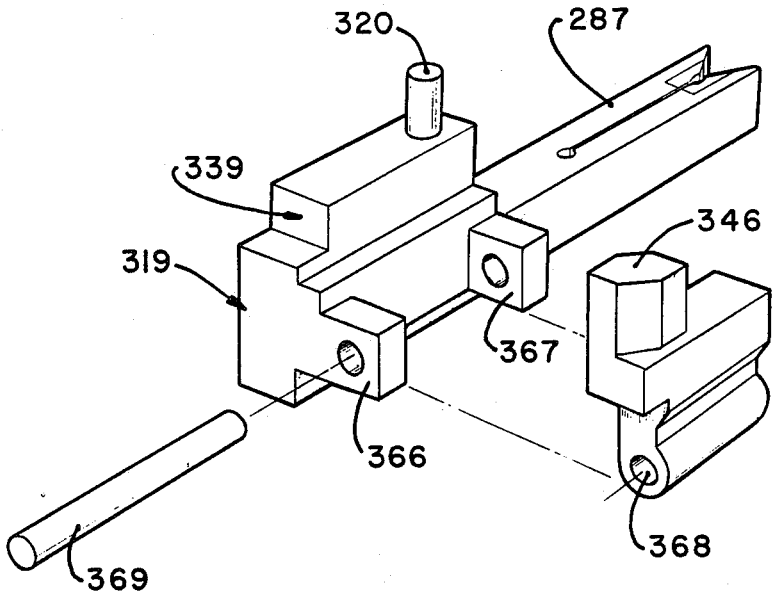
FIG. 11 is a perspective view of a portion of the nail feed assembly according to the present invention.

Referring to FIG. 11, extending from the raised block member 319 perpendicularly to the longitudinal axis of the lower nail feed arm 287 there is provided a pair of spaced mounting flanges 366 and 367. At the lower end of the cam member 346 there is provided a cylindrical hole 368. The cam member 346 is pivotally mounted between the flanges 366 and 367 by means of a pin 369 inserted in the hole 368 through the flanges 366 and 367.

Figure 12:
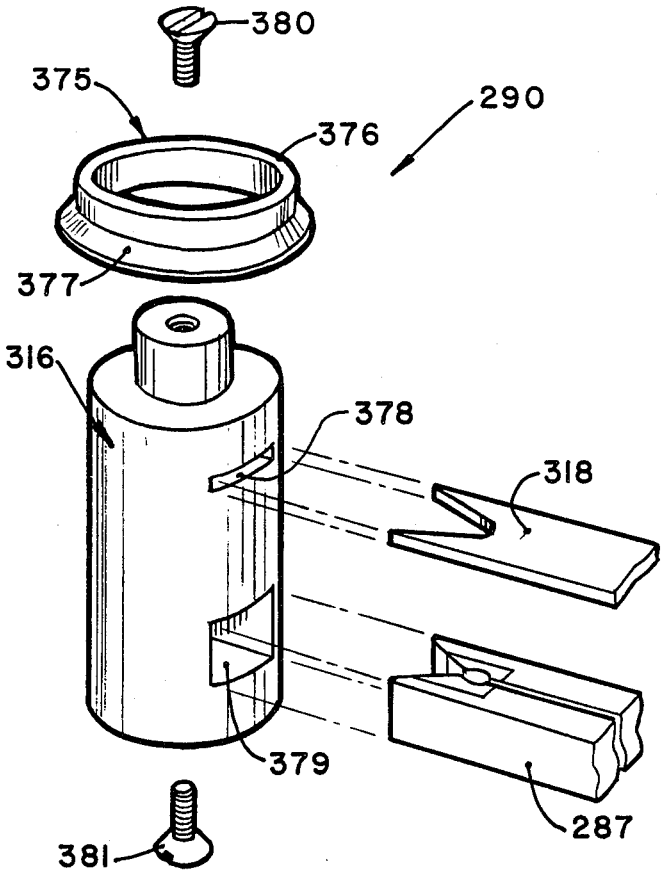
FIG. 12 is an exploded view of a portion of the sprocket assembly according to the present invention.
Figure 15C:
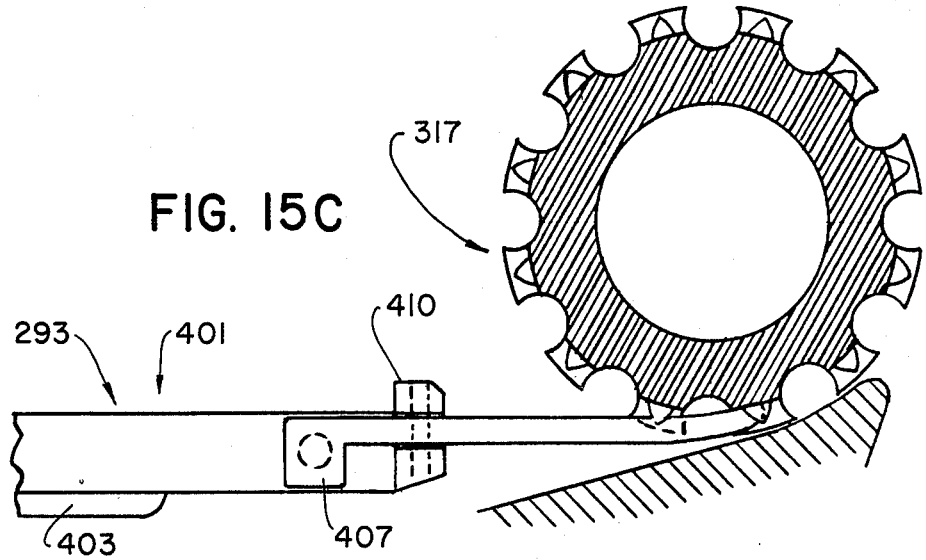
FIG. 15C is a top plan view of FIG. 15A.
Figure 15B:
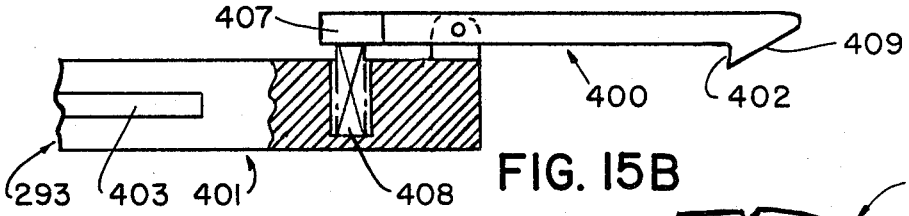
FIG. 15B is a side elevation view of FIG. 15A.
Figure 15A:
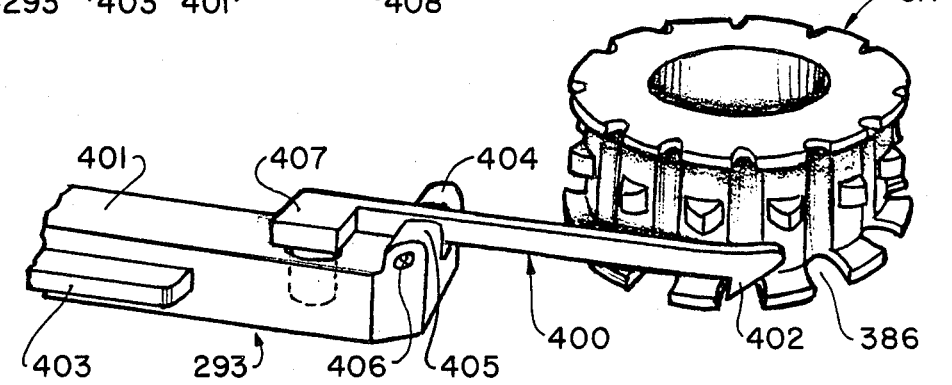
FIG. 15A is a perspective view of the sprocket pawl assembly according to the present invention.

Referring to FIG. 12, there is provided in the sprocket assembly 290 an upper nail feed arm retaining ring 375. The ring 375 is provided with an upper cylindrical ring section 376 and a lower beveled ring section 377. In the sprocket shaft 316 there is provided an upper feed arm passageway 378 and a lower feed arm passageway 379. The sprocket assembly 290 is mounted in the apparatus 200 by means of a pair of screws 380 and 381, as shown more clearly at the bottom of FIG. 5A.

Referring to FIGS. 13A, 13B and 14, there is provided in the tooth sprocket 317 a plurality of upper nail receiving recesses 385, a plurality of lower nail receiving recesses 386 and a plurality of teeth 387. In the center of the sprocket 317 there is provided a shaft receiving hole 388 for receiving the shaft 316.

In the end of the anti-backup member 291 there is provided a pair of spaced pin receiving members 395 and 396. Members 395 and 396 are provided for receiving a pin 397, as shown more clearly in FIG. 13A.

Referring to FIGS. 15A, 15B, 15C and 5C, there is provided in the sprocket advancing assembly 293 a sprocket advancing pawl 400 and an elongated pawl supporting member 401. In the pawl 400 there is provided at the sprocket end thereof a downwardly projecting tooth member 402. The sprocket end portion of the pawl 400 is also bent slightly toward the sprocket 317, as shown more clearly in FIG. 15C. The bend in the sprocket end of the pawl 400 is to enable the tooth member 402 to engage the lower nail receiving recesses 386 in the sprocket 317.

Figure 7:
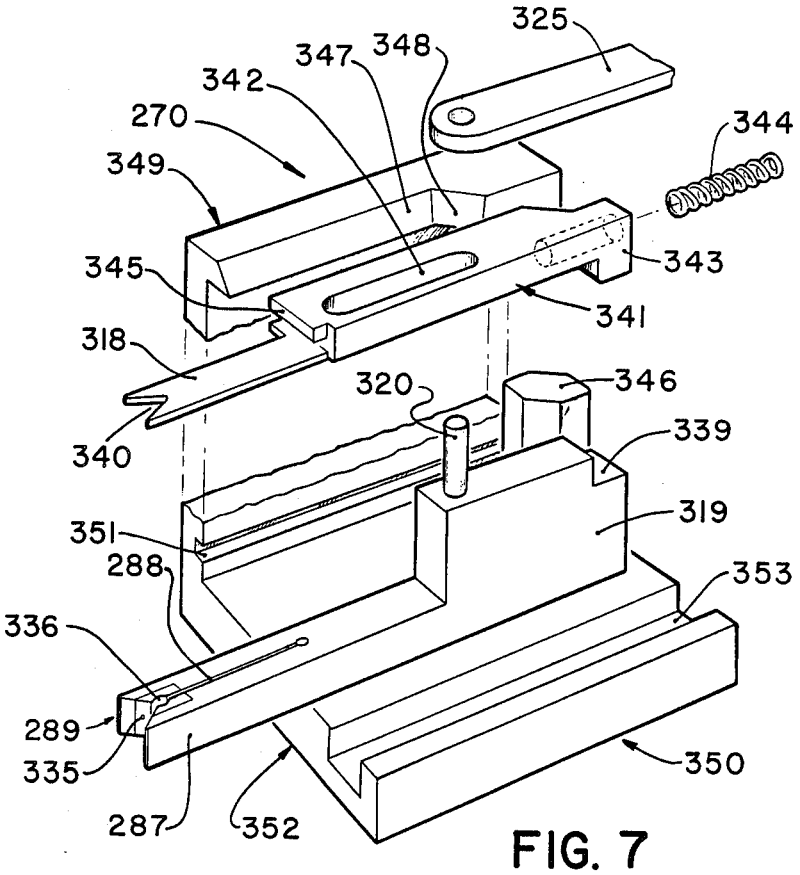
FIG. 7 is an exploded view of a portion of the nail feed assembly according to the present invention.
Figure 10:
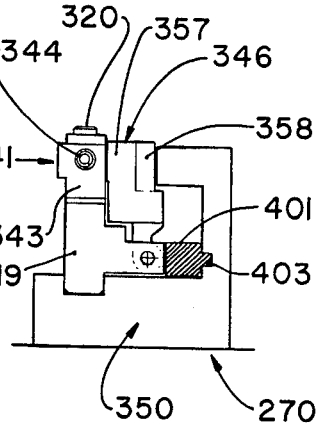
FIG. 10 is an end view of FIG. 9.

In the pawl supporting member 401 there is provided an elongated rectangularly shaped key member 403 which extends along one side of the pawl supporting member 401. The key member 403 is provided for sliding in the slot 351 in the upstanding section 349 of the nail feed assembly 270, as shown in FIGS. 7 and 10. The pawl 400 is pivotally mounted to the pawl supporting member 401 between a pair of upstanding flange members 404 and 405 by means of a pin 406. The opposite end of the pawl 400 is provided with a spring plate 407. A spring 408 is inserted in a hole provided therefor in the pawl supporting member 401 to bear against the spring plate 407 to force the tooth member 402 on the end of the pawl 400 to engage the lower nail receiving recesses 386. The tooth member 402 is also provided with a beveled surface 409 which enables the pawl 400 to ride over the outward projections forming the nail receiving recesses 386 when the assembly 293 is advanced toward the sprocket 317.

At opposite ends of the pawl supporting member 401 there is provided a pair of outwardly extending flange members 410 and 411 which are engaged by the mounting flanges 366 and 367 extending outwardly from the raised block member 319 in the nail feed assembly 270 when the nail feed assembly is moved back and forth by the nail feed piston assembly 275, as shown more clearly in FIG. 5C.

Figure 16:
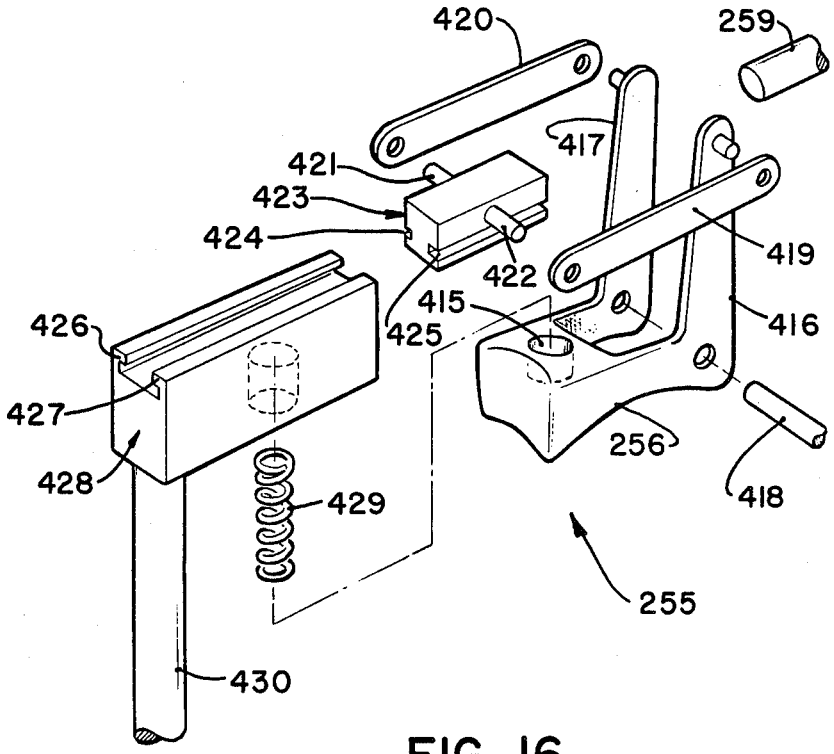
FIG. 16 is an exploded view of a portion of a trigger assembly according to the present invention.

Referring to FIG. 16, there is provided in the trigger member 256 in the trigger assembly 255 a spring receiving hole 415. At the rear end of the trigger member 256 there is provided a pair of spaced upstanding arms 416 and 417. The lower ends of the arms 416 and 417 are provided with a pair of pin receiving holes for pivotally mounting the trigger members 256 in the lower forward handle section 202 by means of a pin 418 as shown in FIG. 5A. The upper ends of the arms 416 and 417 are each pivotally connected to a pair of linking members 419 and 420. The forward ends of the linking members 419 and 420 are pivotally coupled to a sliding block 423 by means of a pair of pins 421 and 422 which extend outwardly from the block 423. Along the lower edges of the block 423 there is provided a pair of elongated slots 424 and 425. The slots 424 and 425 are provided for slidably engaging a pair of inwardly directed flange members 426 and 427, respectively, in a depth control trigger block 428. Mounted in a hole provided therefor in the trigger block 428 and in the hole 415 of the trigger member 256 there is provided a spring 429. Extending downwardly from the forward end of the depth control trigger block 428 there is provided a depth control rod 430.

Figure 17:
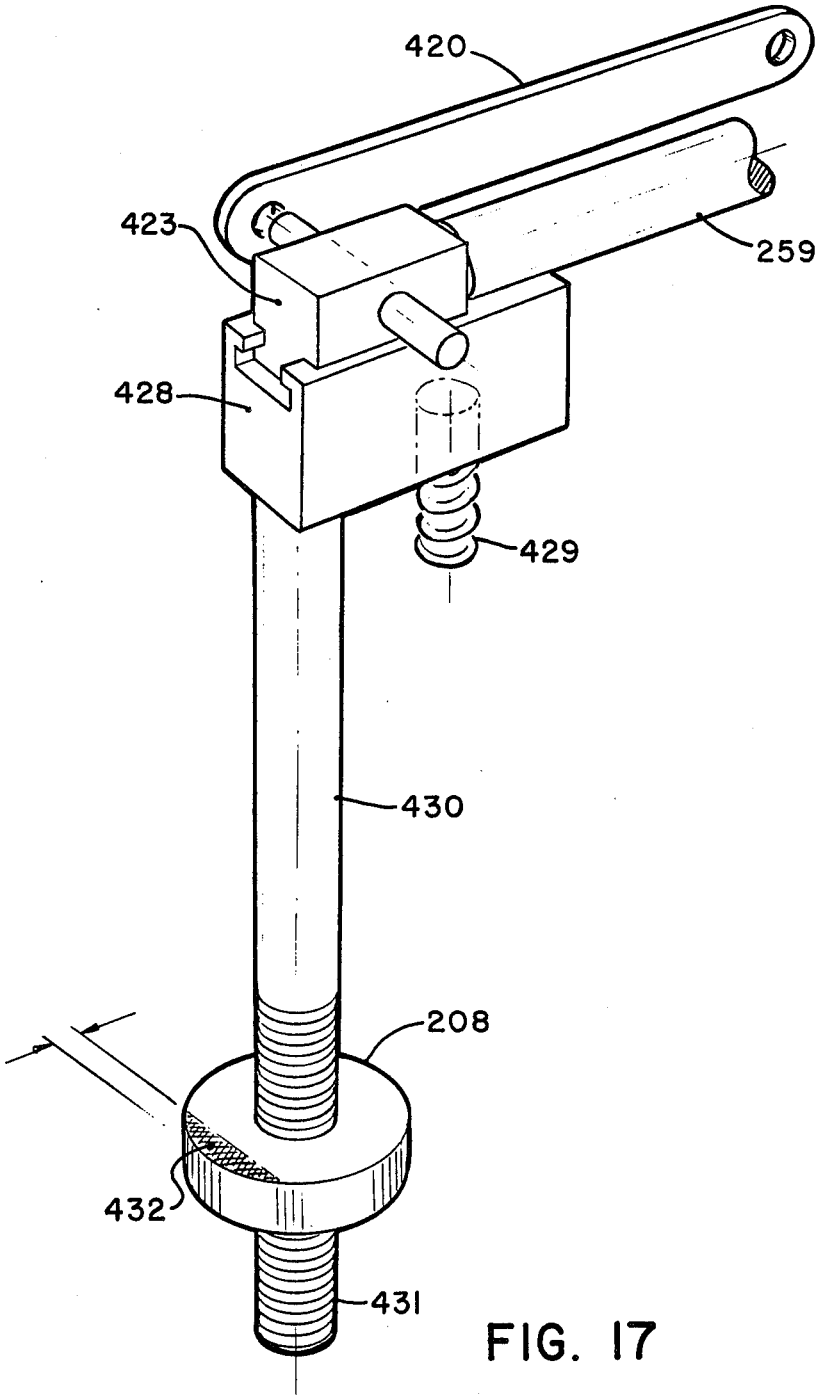
FIG. 17 is a perspective view of a depth control rod according to the present invention.
Figure 18:
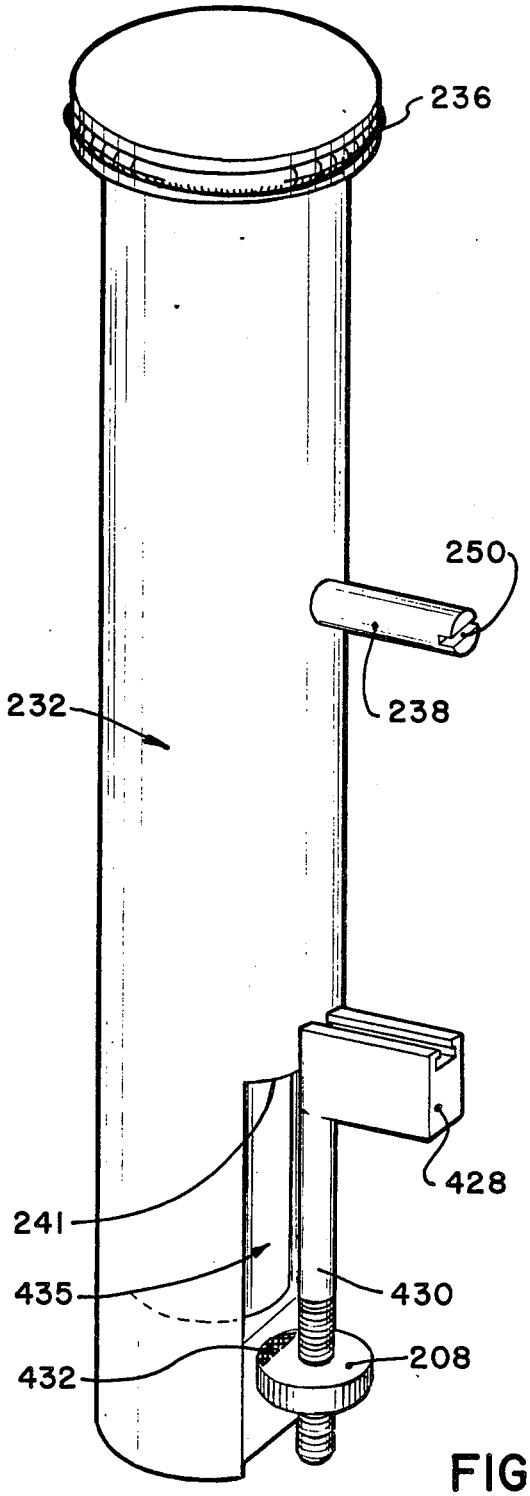
FIG. 18 is a perspective view of a hammer assembly according to the present invention.

Referring to FIG. 17, the lower end of the control rod 430 is provided with threads 431 for threadably receiving the depth control adjusting nut 208. The shaded area 432 of nut 208 represents that portion of the surface of the nut 208 which is engaged by the shoulder 241 of the hammer assembly 232 when the hammer assembly 232 is driven downwardly, as shown more clearly in FIGS. 5A and 18.

Referring to FIGS. 18–23, there is provided in the interior of the hammer assembly 232 a piston cylinder 435. In the wall of the cylinder 435, as shown in FIG. 19A, there is provided a pair of spaced holes 437 and 438. Holes 437 and 438 are provided for exhausting air from the cylinder 435 to the atmosphere through the space between the cylinder 435 and the interior of the exterior wall of the hammer assembly 232 and the recess portion 240.

At the upper end of the hammer assembly 232, as shown in FIGS. 19A, 19B, 19C, 20 and 21, there is provided a flutter valve assembly 440. In the flutter valve assembly 440 there is provided an annular flutter valve chamber 441. In the chamber 441 there is provided an annular flutter valve member 442. Above the member 442 there is provided an upper ring air manifold 443. Below the valve member 442 there is provided a lower ring air manifold 444. The volume of the upper ring air manifold 443 is smaller than the volume of the lower ring air manifold 444 in order to provide a pressure differential between the upper and lower ring air manifolds. Extending from the valve chamber 441 into the upper end of the piston chamber 435 there is provided an air passageway 445. Extending upwardly from the valve chamber 441 there is provided another air passageway 446. Extending perpendicularly to the air passageway 446 is another air passageway 447. Extending upwardly from the upper ring manifold 443 there is provided an air passageway 448. Air passageway 448 is provided for passing air from the air passageway 305 through the hose 233 to the upper ring manifold 443.

Below the piston 436, as shown in FIGS. 19E, 20, 22 and 23, there is provided a dimple head assembly 450. In the assembly 450 there is provided an end block 451 mounted to the lower ends of the walls of the hammer assembly 232 including the lower ends of the walls of the piston cylinder 435. Inserted in a hole provided therefor in the center of the block 451 there is provided a flat-headed bolt-shaped member 452. Located between the under surface of the top of the bolt-shaped member 452 and the top of the block 451 there is provided a spring 453. The spring 453 serves to decouple the mass of the piston 436 and members 452 and 224 from the mass of the remainder of the assembly 232 for more effective hammering. Surrounding the stem of the bolt-shaped member 452 within the bore of the block 451, there is provided an O-ring 454. At the lower end of the member 452 there is provided a rubber washer 455, a metal washer 456 and a C-clamping ring 457. The ring 457 provides a clearance between the ring 457 and the member 224 for the insertion of a dimple forming member removal tool, such as a pin (not shown), inserted in a hole 449 provided therefor in the member 452. Threaded on the member 452 there is provided the dimple forming member 224. In the center of the member 224 is a recessed convex nailhead receiving surface 458.

Figure 19A:
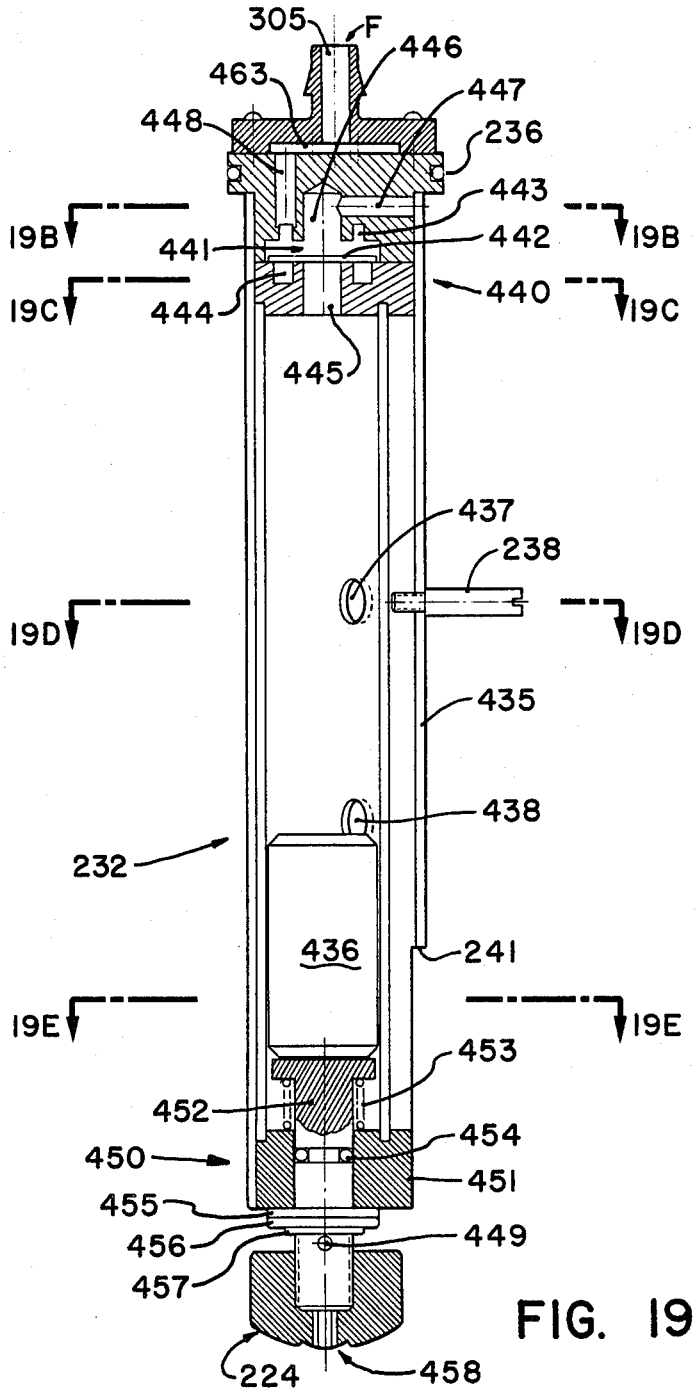
FIG. 19A is a cross-sectional view of the apparatus of FIG. 18.
Figure 19B:
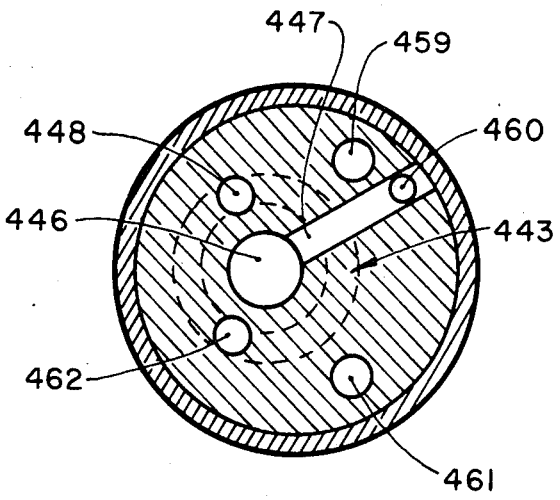
FIG. 19B is a cross-sectional view taken in the direction of lines 19B—19B of FIG. 19A.
Figure 20:
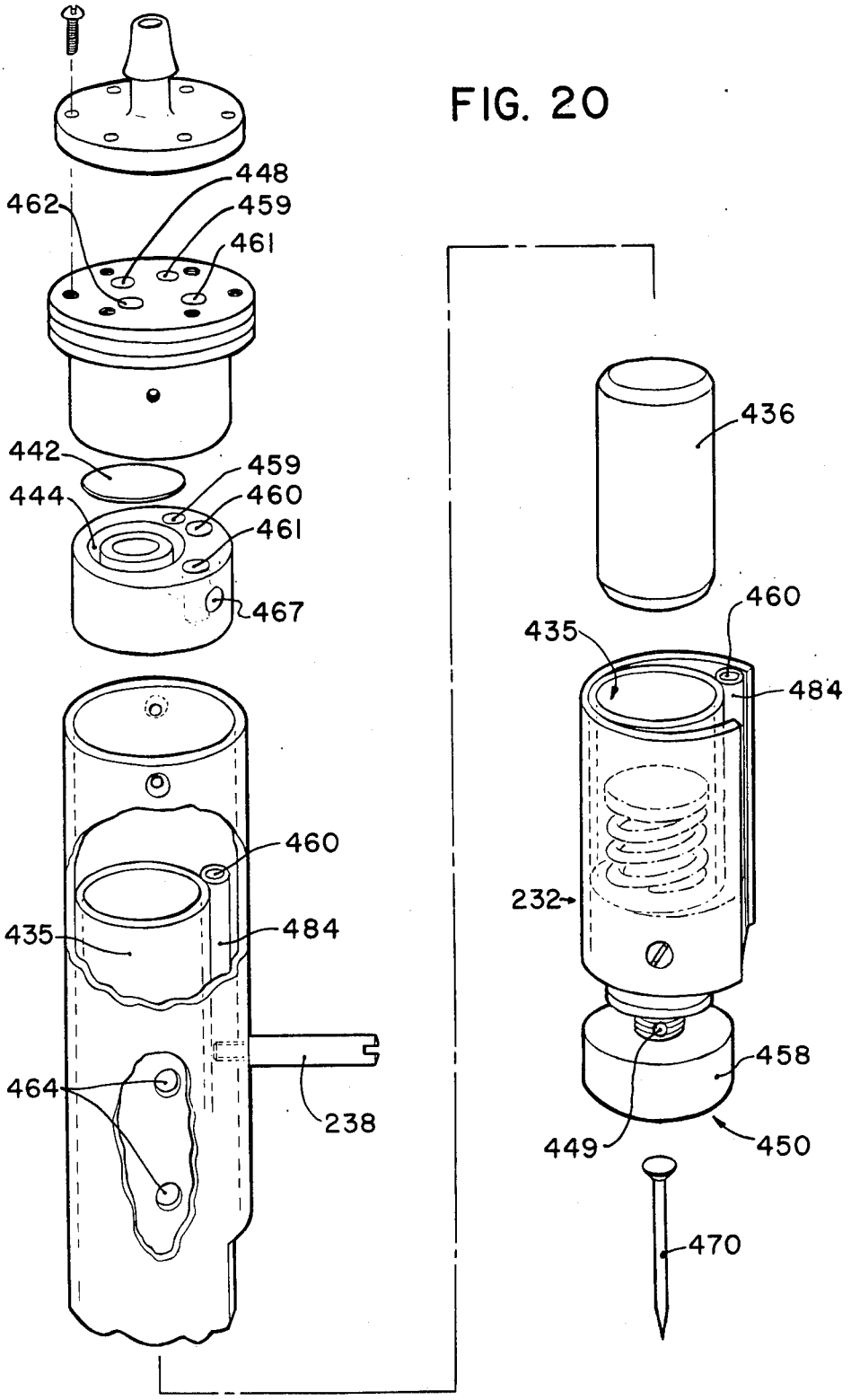
FIG. 20 is an exploded view of the hammer assembly according to the present invention.
Figure 21:
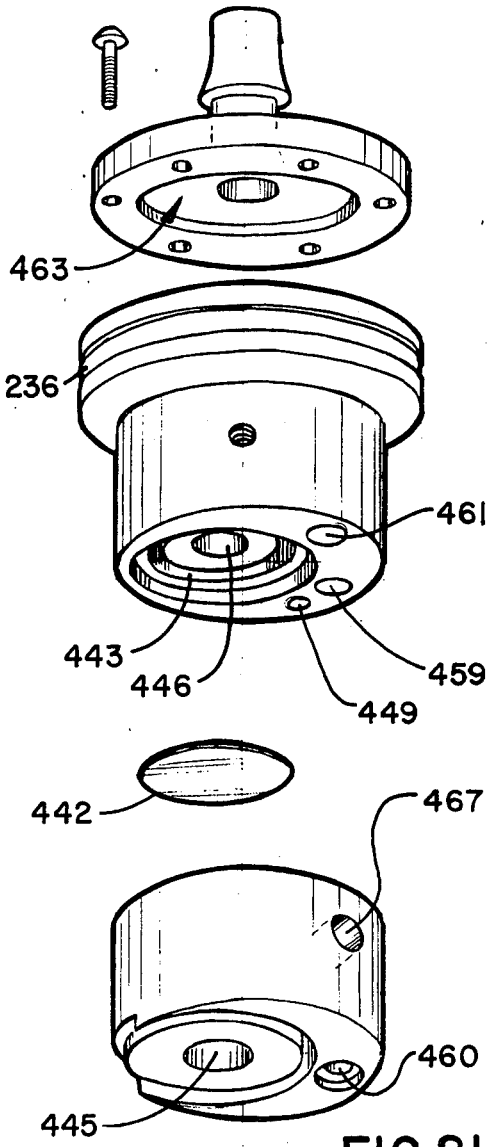
FIG. 21 is an exploded view of the upper portion of the hammer assembly of FIG. 20.
Figure 22:
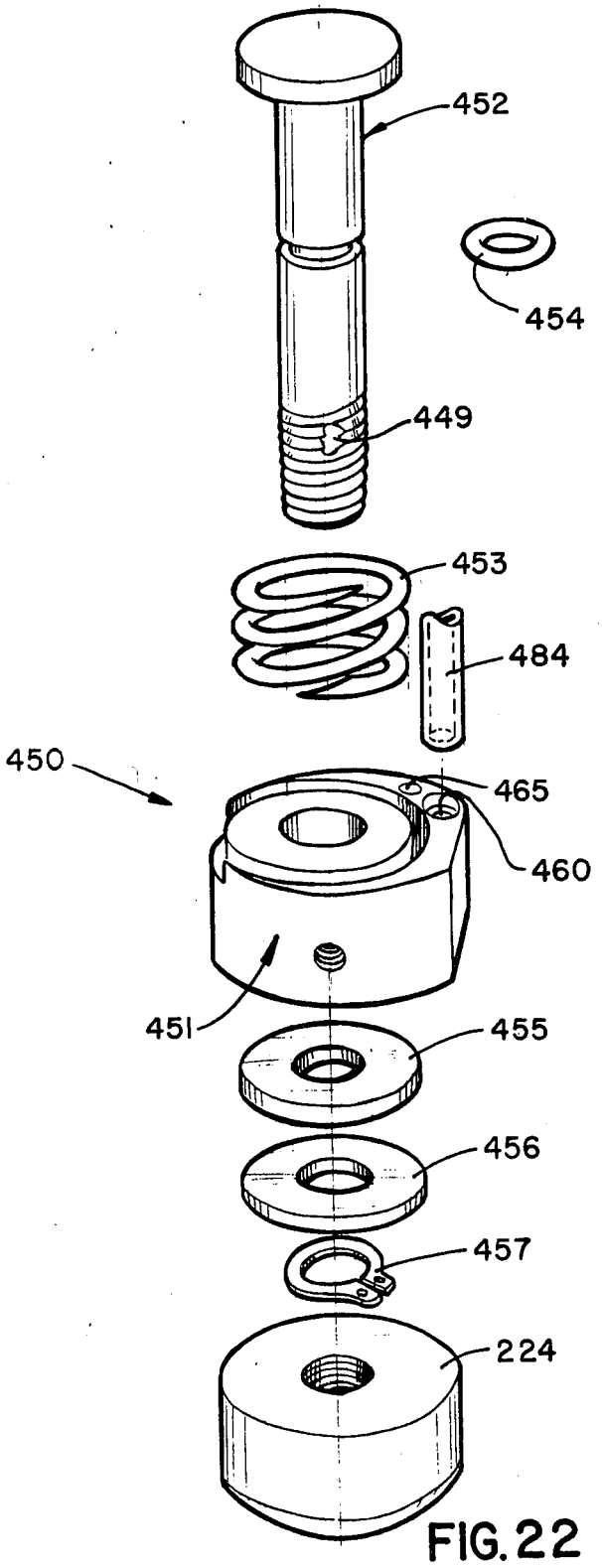
FIG. 22 is an exploded view of the lower portion of the hammer assembly of FIG. 20.

Referring to FIG. 19B, there is provided around the air passageway 446 in the flutter valve assembly 440 a plurality of additional vertically extending air passageways 459, 460, 461 and 462. Air passageways 459 and 461 are provided for communicating air from a chamber 463 at the top of the hammer assembly 232, as shown in FIG. 19A, to the lower ring manifold 444. Air passageway 460 is provided for communicating air from the air passageway 447 to the piston cylinder 435 below the piston 436 via a pipe 484, as shown in FIG. 20, for raising the piston and also for lowering the flutter valve when the piston 436 is driven down. The air passageway 462 is provided for communicating air between the chamber 463 and the upper ring manifold 443 in the same manner as air passageway 448. The two passageways 448 and 462 and passageways 459 and 461 are required to provide sufficient volume to the upper ring manifold 443 and lower ring manifold 444, respectively.

Figure 19C:
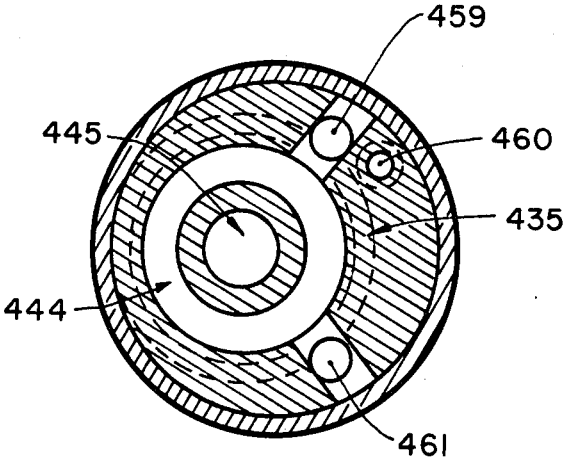
FIG. 19C is a cross-sectional view taken in the direction of lines 19C—19C of FIG. 19A.

Referring to FIG. 19C, there is shown in plan view the relative sizes of the air passageways 445, 459, 460 and 461, as well as the size and shape of the lower ring manifold 444.

Figure 19D:
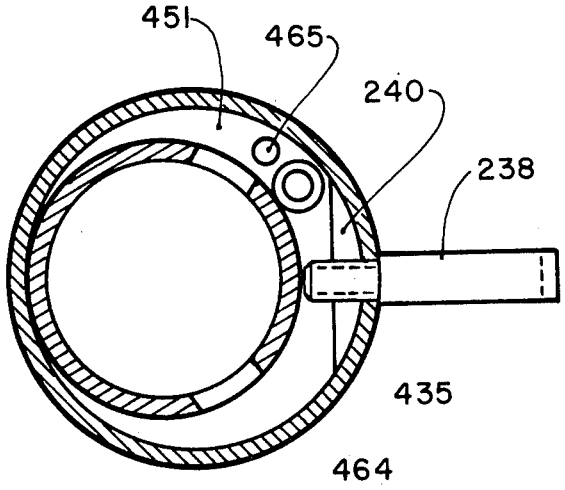
FIG. 19D is a cross-sectional view taken in the direction of lines 19D—19D of FIG. 19A.

Referring to FIG. 19D, there is provided in the walls of the piston cylinder 435 in addition to the exhaust holes 437 and 438, a second corresponding pair of exhaust holes 464, only one of which is shown in the figure. In will be noted also from FIG. 19D that there is provided in the dimple head assembly end block 451, an air exhaust hole 465. Hole 465 is provided to assist exhausting air from the cylinder 435 because of the presence of tube 484.

Figure 19E:
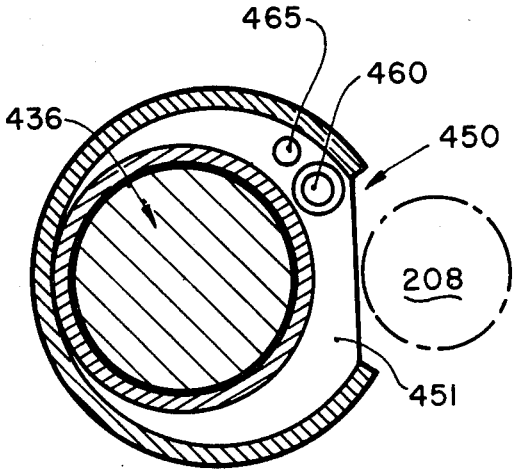
FIG. 19E is a cross-sectional view taken in the direction of lines 19E—19E of FIG. 19A.

Referring to FIG. 19E, it will be noted that the adjusting nut 208 is shown in phantom.

Referring to FIG. 20, it will be noted that the air passageway between passageway 461 and the lower ring manifold 444 is provided by a hole drilled perpendicular thereto designated 467. This technique is also used for forming other passageways in the assembly 232.

Figure 23:
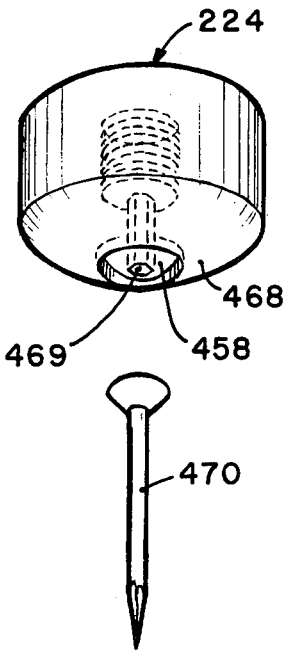
FIG. 23 is a lower perspective view of a dimple-forming member according to the present invention.

Referring to FIG. 23, there is provided in the dimple forming member 224 a spherical surface 468 and a recessed spherical surface 458. The surface 468 provides the shape of the dimple in the surface into which the member 224 is depressed. The surface 458 is provided for receiving the head of a nail 470, as described below. In the center of the surface 458 there is provided an elongated hexagonal hole 469. Hole 469 is provided to facilitate the removal of the member 224 from the bolt-shaped member 452.

Figure 24B:
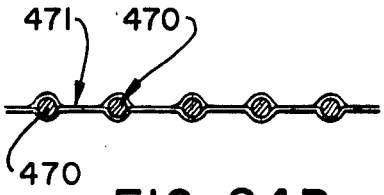
FIG. 24B is a cross-sectional view taken in the direction of lines 24B—24B of FIG. 24A.
Figure 25:
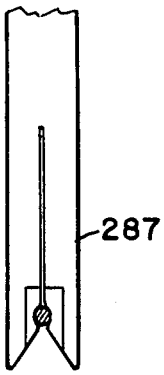
FIG. 25 is a top plan view of the free end of a lower nail feed arm according to the present invention.
Figure 24A:
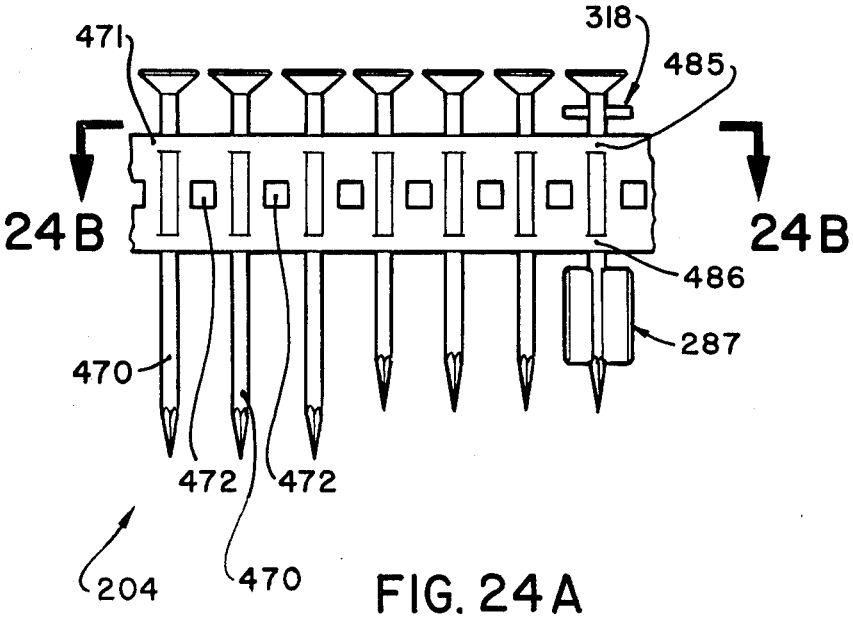
FIG. 24A is a side elevation view of a portion of a nail cartridge according to the present invention.

Referring to FIGS. 24A, 24B and 25, there is provided in the nail cartridge 204 a plurality of nails 470. Each of the nails 470 are inserted in a paper tape 471. In the paper tape 471 between each of the nails 470 there is provided a sprocket hole 472. Sprocket hole 472 is provided for engagement by the teeth 387 of the sprocket 317, as shown in FIG. 6. On the right end of FIG. 24A there is shown a front end view of the upper and lower nail feed arms 318 and 287, respectively. Preferably, the tape 471 comprises the same type of tape which is conventionally used in conjunction with wall compound for covering the seams between gypsum wallboard. This particular type of tape is found to have high tensile strength. A further advantage of using the tape is that bits and pieces of the tape which may be torn from the main body of the tape during nailing of the drywall to wooden studs will not adversely affect the quality of workmanship when drywall compound is also used for covering the dimpled nails.

In use, as the arms 318 and 287 engage and push the nails 470 from the tape 471, the upper and lower margins 485 and 486 of the tape 471 give way, freeing the nails 470 therefrom.

Figure 26:
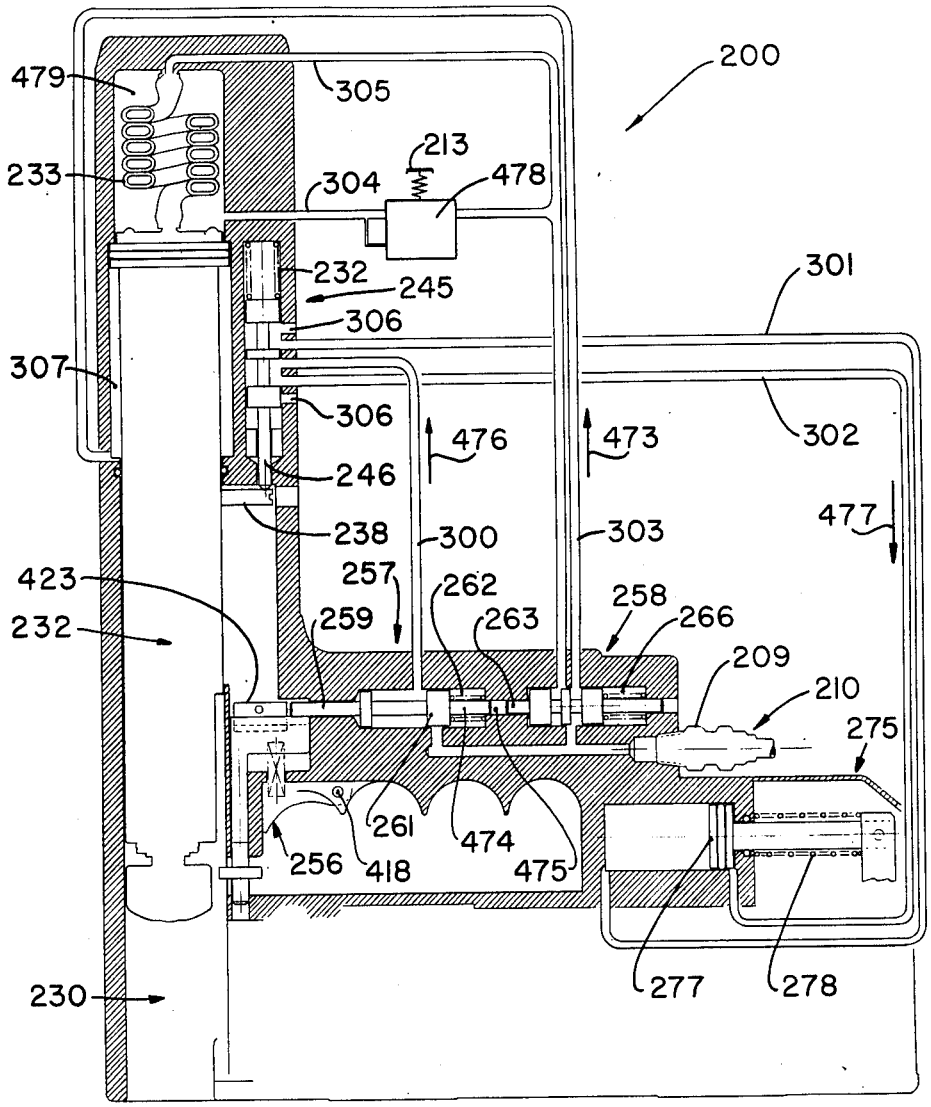
FIG. 26 is a diagram of air lines showing one stage of the operation of the present invention.
Figure 27:
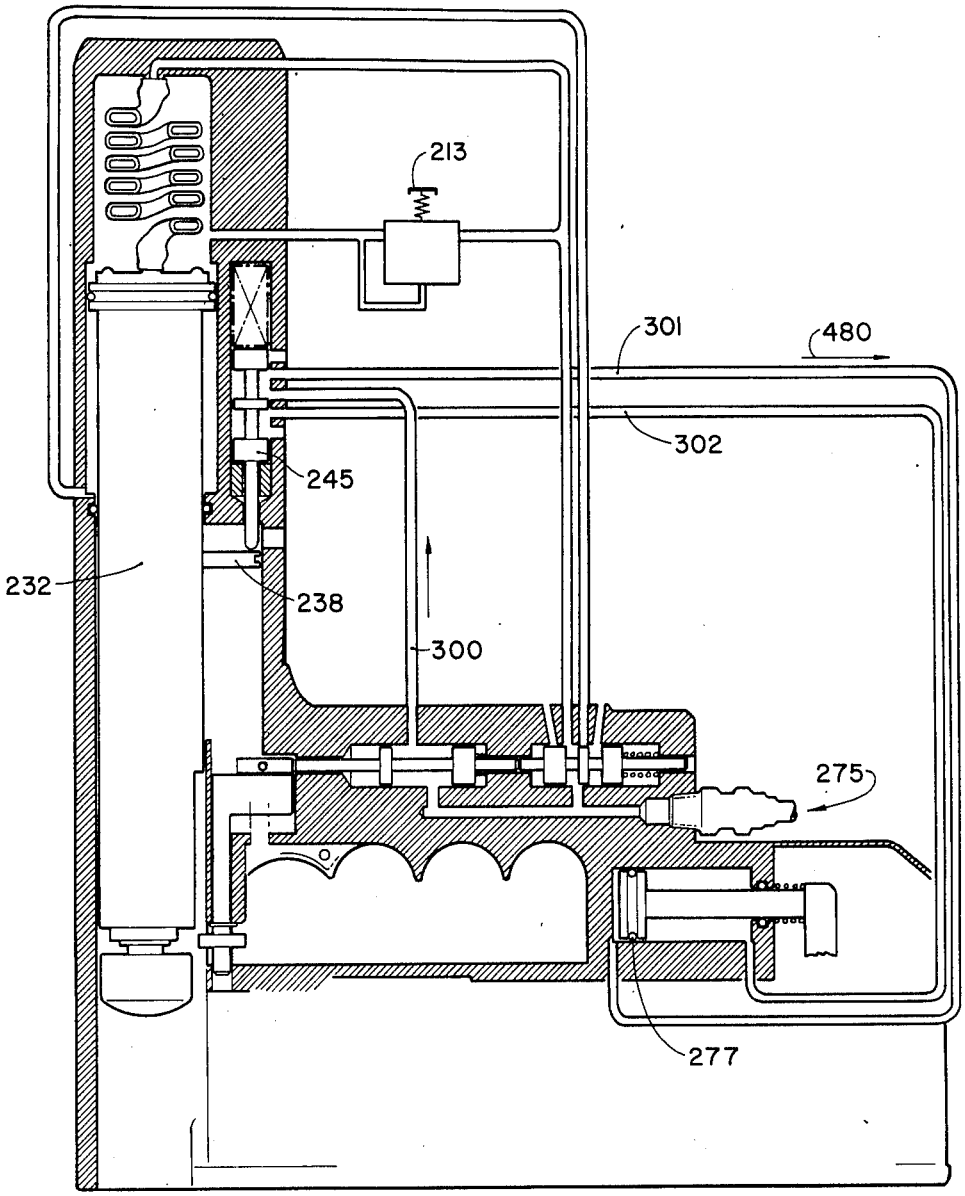
FIG. 27 is a diagram of air lines showing another stage of the operation of the present invention.
Figure 28:
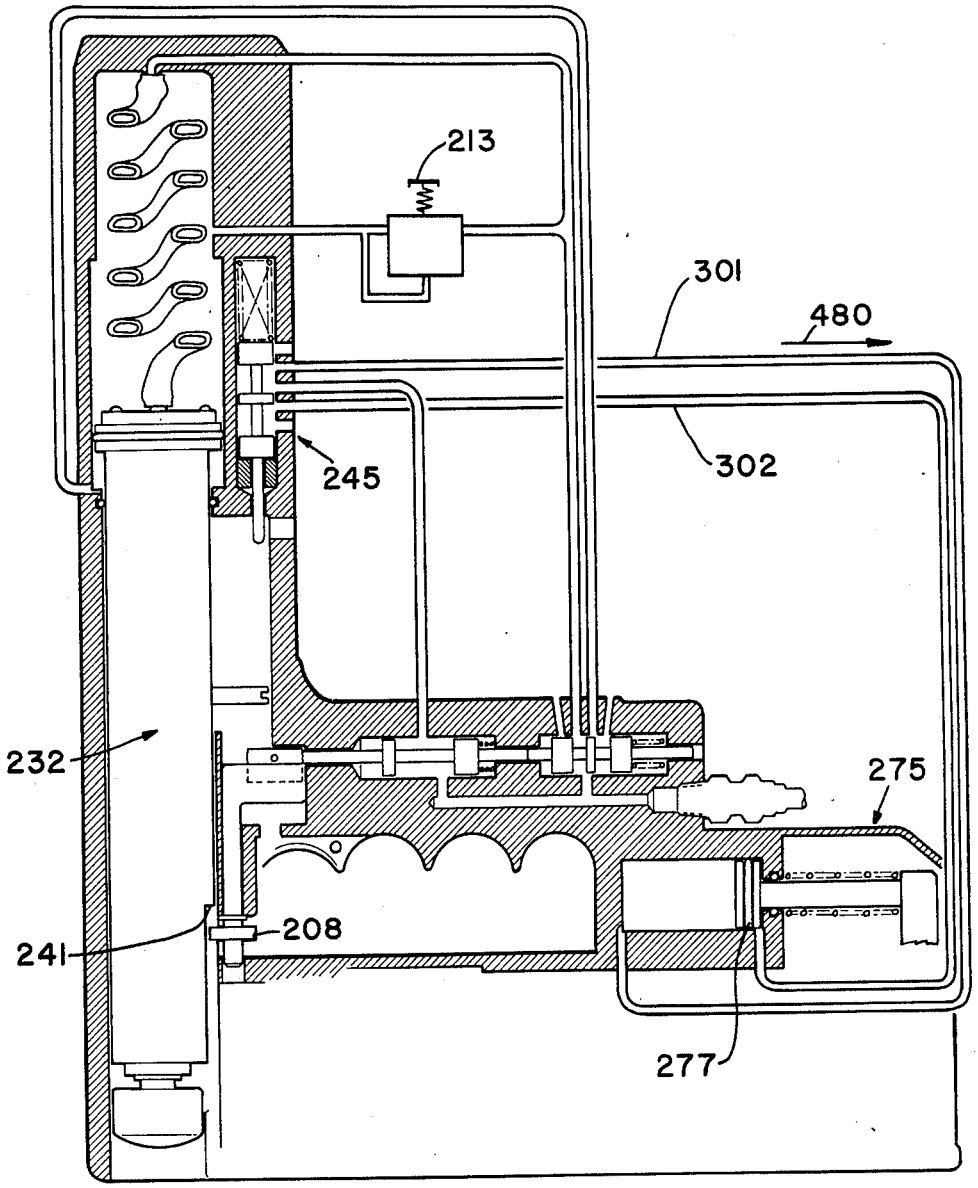
FIG. 28 is a diagram of air lines showing a third stage of the operation of the present invention.

Referring to FIGS. 26, 27 and 28, the operation of the apparatus 200 will now be described. To facilitate the description and an understanding of the operation of the apparatus 200, the internal air passageways 300–306, described above with respect to FIGS. 5D and 5E, are shown as external air lines.

Immediately before compressed air having a pressure of 80 psi is applied to the apparatus 200 by means of the air line 210 and before the trigger member 256 is depressed, the spring 262 holds the valve assembly 257 in its leftmost position. Likewise, the spring 266 holds the valve assembly 258 in its leftmost position. At the same time, the spring 278 holds the piston 277 in the nail feed piston assembly 275 in its rightmost position. It should be noted that when the piston 277 is in the position shown in FIG. 26, the nail feed assembly 270 is fully retracted, as shown in FIGS. 7–10. At this time, the switching valve assembly 245 is either in its fully retracted or raised position as shown in FIG. 26, or it is moved to its lowest position on account of the spring 250, depending upon the position of the hammer assembly 232 and the pin 238 extending therefrom. Without air pressure, friction between the side walls of the cavity 230 and the hammer assembly 232 is the principal thing that prevents the hammer assembly 232 from falling in the cavity 230.

With the valves 257, 258 and 245 and the nail feed piston assembly 275 in the positions shown in FIG. 26, compressed air applied to the apparatus 200 will flow from the fitting 209 to the valves 257 and 258. The air at valve 257 will be blocked by the sealing member 261. At the valve 258 the compressed air will flow through passageway 303 in the direction of the arrow 437 to the cavity in the enlarged section 307 at the top end of the hammer assembly 232. If, instead of being in its raised position as shown in FIG. 26, the hammer assembly 232 was in a lower position or fully extended, the compressed air in the passageway 303 would enter the section 307 and force the hammer assembly upward to the position shown in FIG. 26.

In the valve assembly 257 there is provided in the center of the spring 262 a valve stem 474. Between the end of the valve stem 474 and the end of the valve stem 263 in the valve assembly 258, a predetermined amount of clearance space 475 is provided. The space 475 is provided to permit the valve 257 to open when the trigger 256 is pulled before the valve 258 is moved.

Referring also to FIG. 16, with the apparatus held against wallboard, and the dimple forming member 224 located over a wooden stud, as the trigger member 256 is depressed the trigger member 256 pivots about the pin 418 causing the block 423 to be moved to the right. As the block 423 is moved to the right, it engages the stem 259 of the valve assembly 257 causing the valve assembly 257 to move to the right opening the valve assembly. When the valve assembly 257 is opened, compressed air from the fitting 209 passes through the valve assembly 257 and into the air passageway 300 and to the switching valve assembly 245, as shown by the arrow 476. From the valve assembly 245 the air enters the air passageway 302 leading to the back side of the piston 277 in the nail feed piston assembly 275, as shown by the arrow 477. As the compressed air enters the nail feed piston assembly 275 by means of the air passageway 302, the piston 277 is moved to the left.

Referring to FIGS. 5A, 7–11, as the piston 277 is moved to the left, the linkage rod 325 attached to the pin 320 is advanced. As the rod 325 is advanced, the block 319 carrying the cam member 346 is advanced, advancing the lower and upper arms 287 and 318. As the arms 287 and 318 are advanced, they pass through the slots 379 and 378 in the sprocket shaft 316, as shown in FIG. 12, and engage and remove a nail 470 from the tape 471, as shown in FIGS. 5A. When the projection 345 on the forward end of the member 341 of the upper arm 318, as shown in FIG. 7, contacts the ring section 376, as shown in FIGS. 5A and 7, forward motion of the upper arm is halted, the cam member 346 pivots against the surfaces 347 and 348, as shown in FIGS 7–10 allowing the lower arm 287 to carry the nail 270 to a position beneath the member 224, as shown in FIG. 5A.

At the same time, the forward mounting flange 367 on the block 319 engages the flange member 410 at the forward end of the sprocket advancing assembly 293, as shown in FIG. 5C, causing the pawl 400 to be moved forwardly to engage another of the lower nail receiving recesses 386.

With a nail 470 beneath the member 224, further depression of the trigger 256 causes the valve assembly 257 to move further to the right, causing the stem 474 to bridge the clearance space or gap 475 and contact the stem 263 of the valve assembly 258, moving the valve assembly 258 to the right against the spring 266. As the valve assembly 258 is moved to the right, air passageway 303 is closed off and compressed air enters air passageway 305 and, through a regulator 478, air passageway 304. The air in air passageway 304 enters a cavity 479 above the hammer assembly 232, forcing the hammer assembly 232 downwardly. As the hammer assembly 232 is driven downwardly, it engages the nail 470 placed beneath the dimple forming member 224, driving the nail into the wallboard or any other substrate against which the apparatus 200 is being held. At the same time, the air in passageway 305 enters the top of the hammer assembly 232 through the flexible air hose 233.

Referring also to FIGS. 19A and 19B, as the compressed air enters the top of the hammer assembly 232, it passes through the chamber 463, the air passageways 448 and 462 and the upper ring manifold 443, causing the flutter valve 442 to be pressed downwardly over the lower ring manifold 444. Air from the air passageway 446 then passes through passageway 447 to passageway 460, as shown in FIGS. 19B–19E and 32. As shown in FIG. 20, air passageway 460 comprises the tubular member 484 which extends from air passageway 447 downwardly in the space between the piston cylinder 435 and the interior wall of the hammer assembly 232. At the lower end of the passageway 460, the passageway 460 enters the piston chamber below the piston 436. Air in the passageway 460 causes the piston 436 to be driven upwardly. As the piston 436 is driven upwardly, flutter valve 442 is driven open, allowing compressed air from air passageways 459 and 461 and the lower ring manifold 444, as shown in FIG. 19C, to enter the passageway 445. As air in the passageway 445 enters the piston chamber, the piston 436 is driven downwardly against the bolt-shaped member 452 in the dimple head assembly 450. As the piston 436 is driven downwardly, the flutter valve returns to its initial position, as shown in FIG. 19A, and the above-described raising and lowering of the piston 436 is repeated.

Referring to FIG. 27, after the hammer assembly 232 and the valve actuating pin 238 are moved downwardly a short distance, after the nail is partially driven into the underlying material and before the dimple forming member 224 strikes the lower nail feed arm 287, the valve assembly 245 switches the air flow to the mail feed piston assembly 275. That is to say, the air from air passageway 300 which heretofore flowed in the air passageway 302, now flows in the air passageway 301 in the direction of the arrow 480. As the air in passageway 301 enters the piston chamber of the nail feed piston assembly 275, the piston 277 is driven to the right, retracting the nail feed assembly 270 and the sprocket advancing assembly 293. The retraction of the nail feed assembly 270 and the sprocket advancing assembly 293, comprising the reverse of the above-described operations for advancing the assemblies 270 and 293, is required to prevent the hammer assembly 232 from striking the lower feed arm 287 in the nail feed assembly, to advance a succeeding nail into position in front of the arms 287 and 318, and to ready the nail feed assembly 270 to inject the succeeding nail beneath the hammer assembly 232. It will be noted that the retraction of the assembly 293 is effected by the engagement of the flanges 366 and 411.

Referring to FIG. 28, as the piston 436 is reciprocated in the cylinder 435 and the hammer assembly 232 is driven downwardly against a nail, the shoulder 241 approaches and eventually forces the dimple adjusting nut 208 downwardly.

Figure 29:
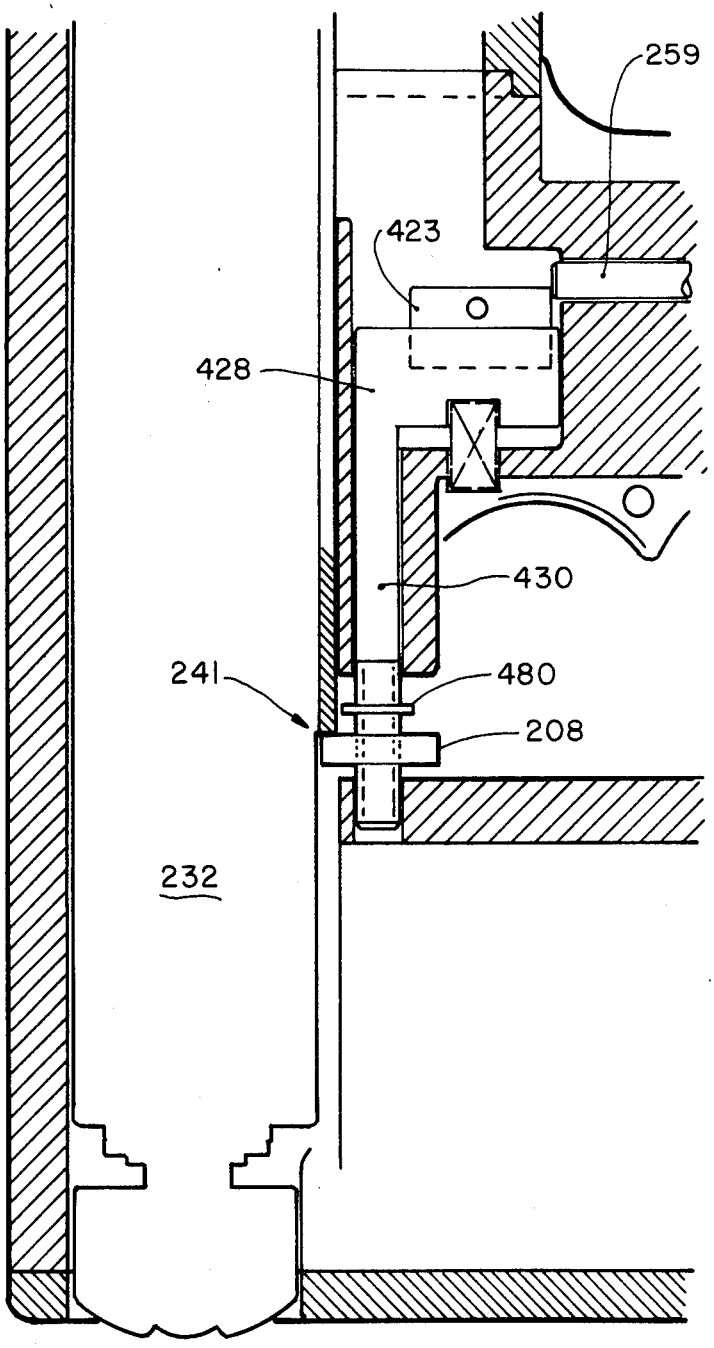
FIG. 29 is a cross-sectional view showing a stage of the operation of the present invention.

Referring to FIG. 29, as the shoulder 241 of the hammer assembly 232 engages the nut 208, the depth control rod 430 and the depth control trigger block 428 and block 423 are pulled downwardly.

Figure 30:
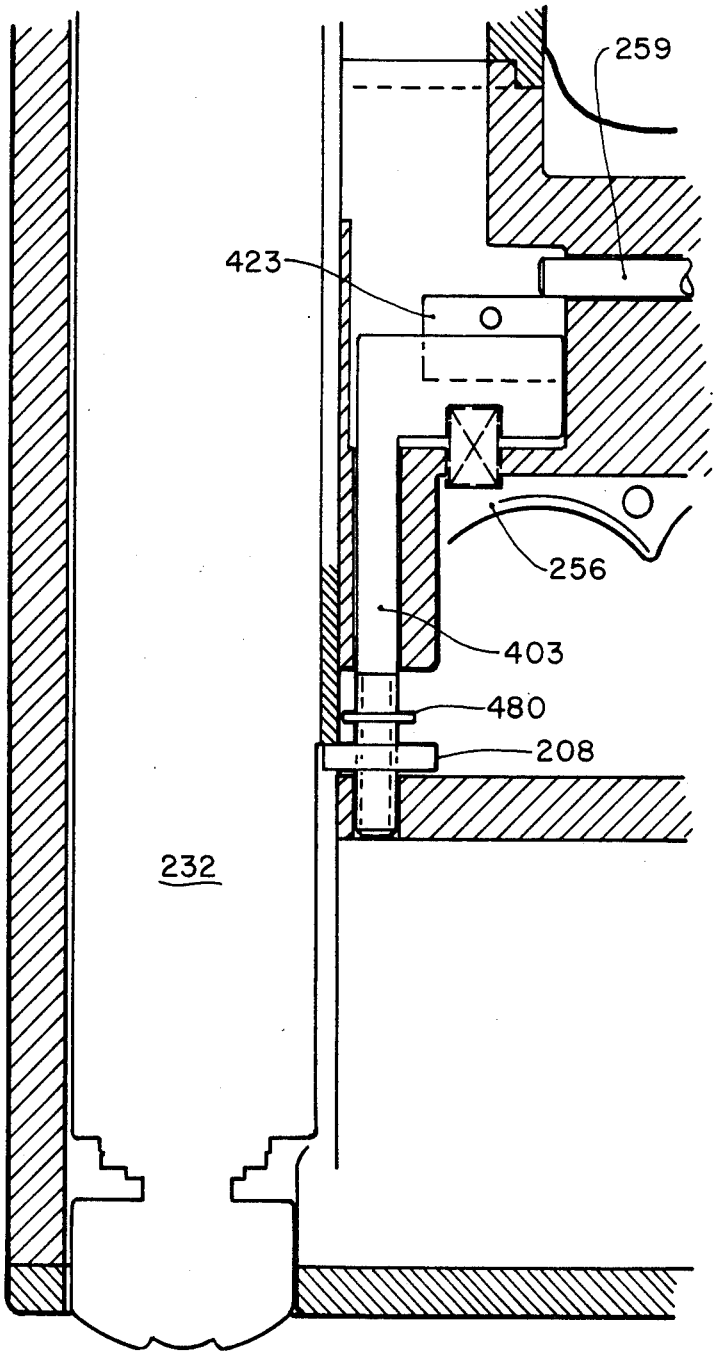
FIG. 30 is a cross-sectional view showing another stage of the operation of the present invention.

Referring to FIG. 30, when the hammer assembly 232 has formed a dimple having the desired depth as determined by the position of the nut 208 on the rod 430, the block 423 has been moved below the stem 259 of the valve assembly 257. With the block 423 located below the valve stem 259, both of the valve assemblies 257 and 258 are free to return to their initial position, as shown in FIG. 26. With the valve assemblies 257 and 258 in their initial positions as shown in FIG. 26, air to passageway 300 is blocked and compressed air through valve assembly 258 is directed into passageway 303 raising the hammer assembly 232 which, in turn, raises the switching valve assembly 245. At this point, the trigger member 256 must be released in order to initiate a new cycle of operation.

Figure 31:
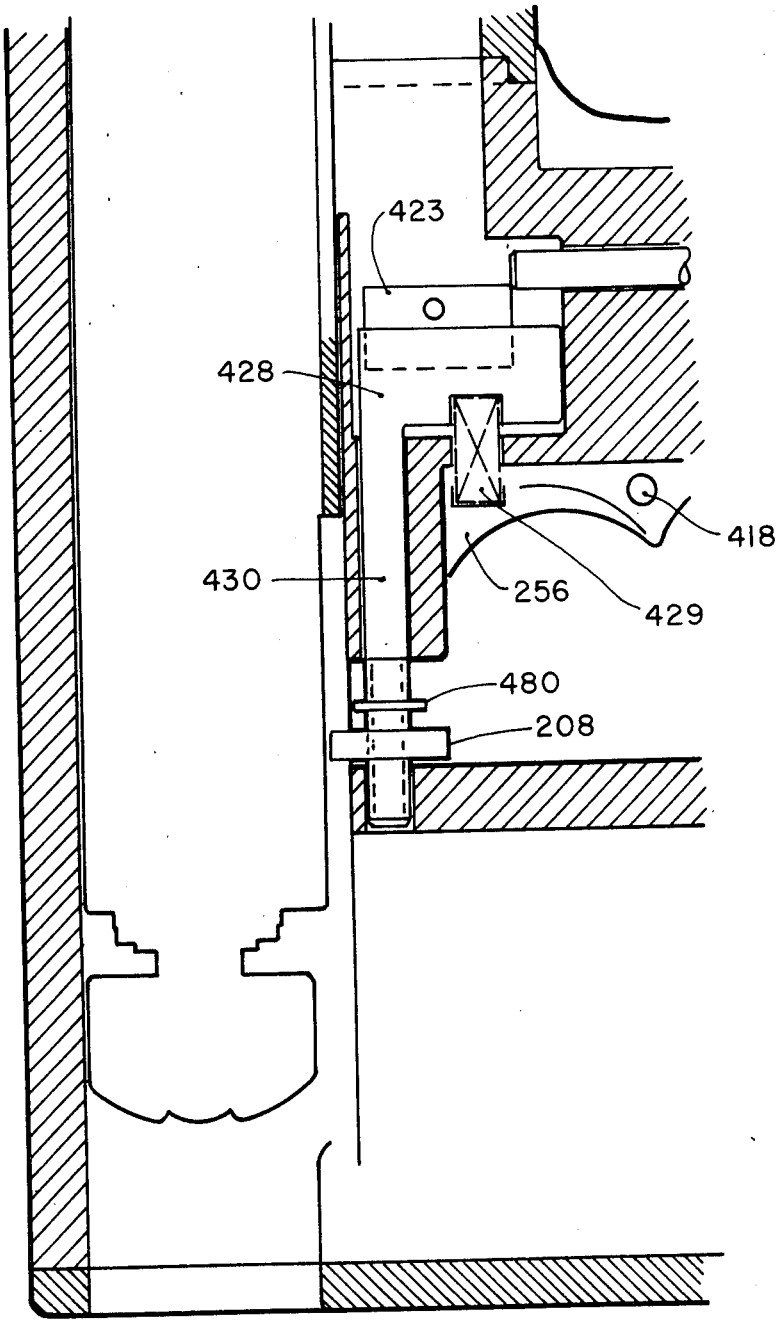
FIG. 31 is a cross-sectional view showing still another stage of the operation of the present invention.

Referring to FIG. 31, releasing the trigger member 256 allows the spring 429 to pivot the trigger member about the pin 418 in such a manner that the block 423 is moved to its leftmost position on the depth control trigger block 428. When the block 423 is moved to its leftmost position on the depth control trigger block 428, the spring 429 raises the block 423, the block 428, the depth control rod 430 and the adjusting nut 208 to their initial position, as shown in FIG. 26. To limit the upward movement of the blocks 423 and 428 and rod 430, there is provided above the nut 208 a C-ring 480.

Figure 32:
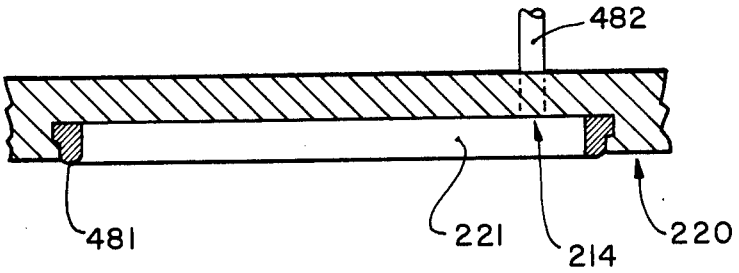
FIG. 32 is a cross-sectional view showing a recess in the vacuum sole plate according to the present invention.

Referring to FIG. 32, to facilitate the placement of the base 220 of the apparatus 200 flat against a wall surface or the like, a rubber O-ring 481 is placed around the circumference of each of the holes 221 and 222, only one of which is shown in FIG. 32. The thickness of the O-ring 481 is such that it projects slightly below the surface of the base 220 so as to form an airtight seal with the surface against which the base 220 is pressed. A source of vacuum (not shown) is attached to the holes 221 and 222 by means of holes 214 for providing a vacuum therein when the base 220 is placed flat against the surface.

Figure 33:
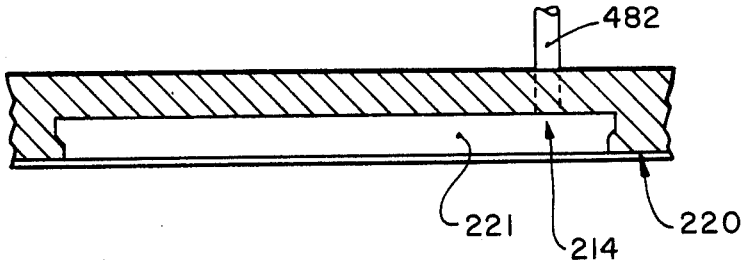
FIG. 33 is a view of another embodiment of a sole plate according to the present invention.

Referring to FIG. 33, in lieu of the O-ring 481 a soft rubber pad 483, or the like, may be mounted to the base 220.

Figure 34:
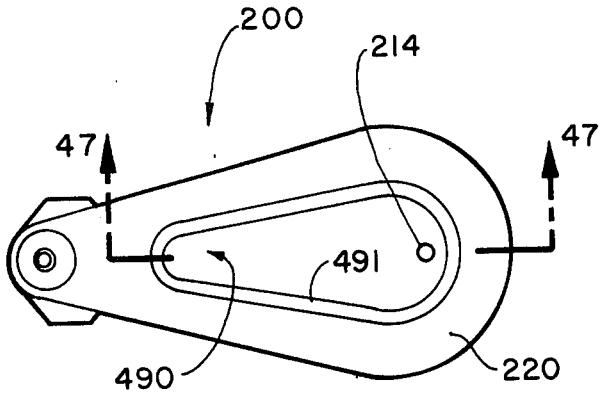
FIG. 34 is a bottom plan view of another embodiment of a sole plate according to the present invention.
Figure 35:
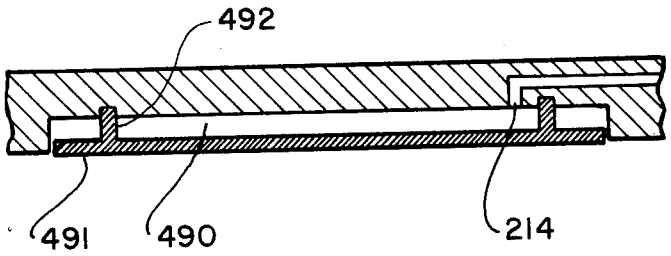
FIG. 35 is a side cross-sectional view of the embodiment of FIG. 34.

Referring to FIGS. 34 and 35, in another embodiment of the invention, the base member 220 of the apparatus 200 is provided with a cone-shaped recess 490 which is rounded on both ends. Mounted around the edge of the cone-shaped recess 490 there is provided a relatively thin narrow, ring-shaped rubber strip 491. Around the inside edge of the strip 491 and extending inwardly perpendicularly thereto there is provided a flange 492. The flange 492 is fixed in a slit provided therefor interior of the walls of the recess 490 for holding the strip 491 in the recess 490. When suction is generated in the recess 490, the outside edge of the strip 491 flexes outwardly forming a vacuum-tight seal between the base 220 and the wallboard or other surface against which the apparatus 200 is held.

Figure 36:
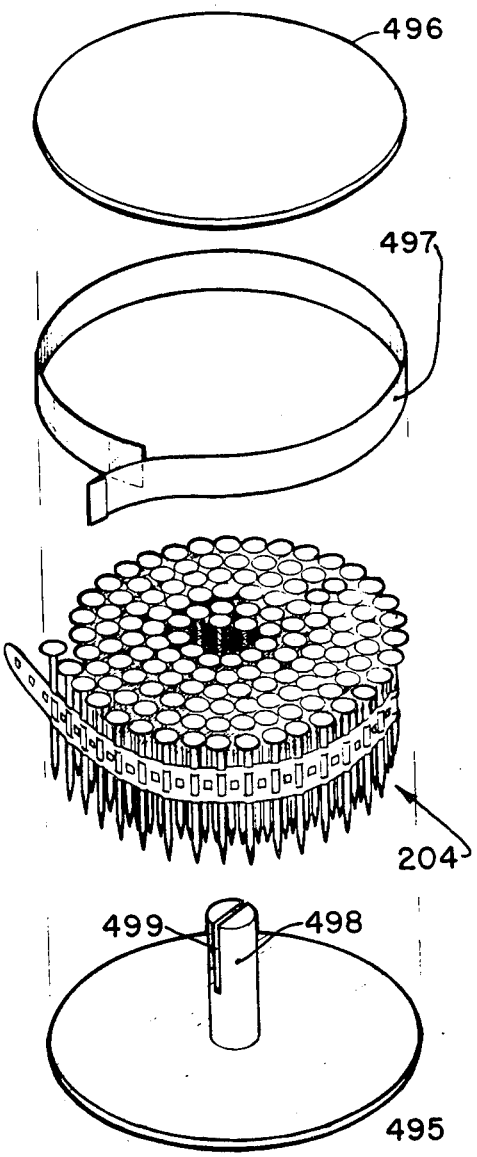
FIG. 36 is a nail cartridge according to the present invention.

Referring to FIG. 36, there is provided in accordance with another embodiment of a cartridge 204 of FIG. 1 a pair of disk-shaped members 495 and 496 and a ribbon tie 497. Extending vertically from the center of the disk-shaped member 495 there is provided a post 498. The center of the post 498 is provided with a slot 499. The slot 499 is provided for receiving a tool or the like which is used for winding the cartridge of nails 204 about the post 498. After the cartridge of nails 204 is wound about the post 498, the ribbon tie 497 is placed about the cartridge of nails to hold them from unraveling. Thereafter, the disk member 496 is placed on top of the nails and secured thereto in any suitable fashion. By using the disks 495 and 496, cartridges of nails 204 may be easily stacked for shipment and storage.

Figure 37:
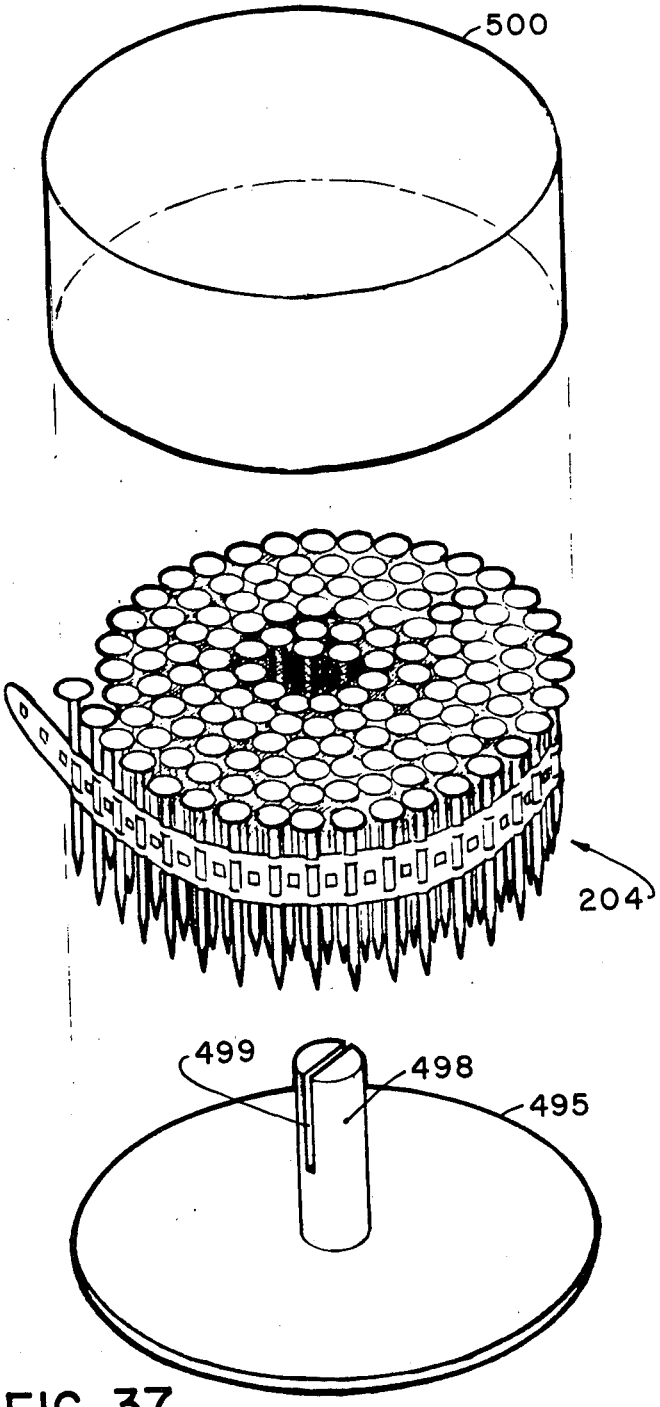
FIG. 37 is another embodiment of a nail cartridge according to the present invention.

Referring to FIG. 37, in still another embodiment of the present invention the disk-shaped member 496 and the ribbon tie 497 is replaced with a wide band 500. The height of the band 500 approximates the length of the nails in the cartridge 204. The flat surface of the heads of the nails 204 in conjunction with the band 500 serves to provide a relatively flat uniform surface for the stacking and storage of a plurality of nail cartridges 204, one on top of another.

Figure 38:
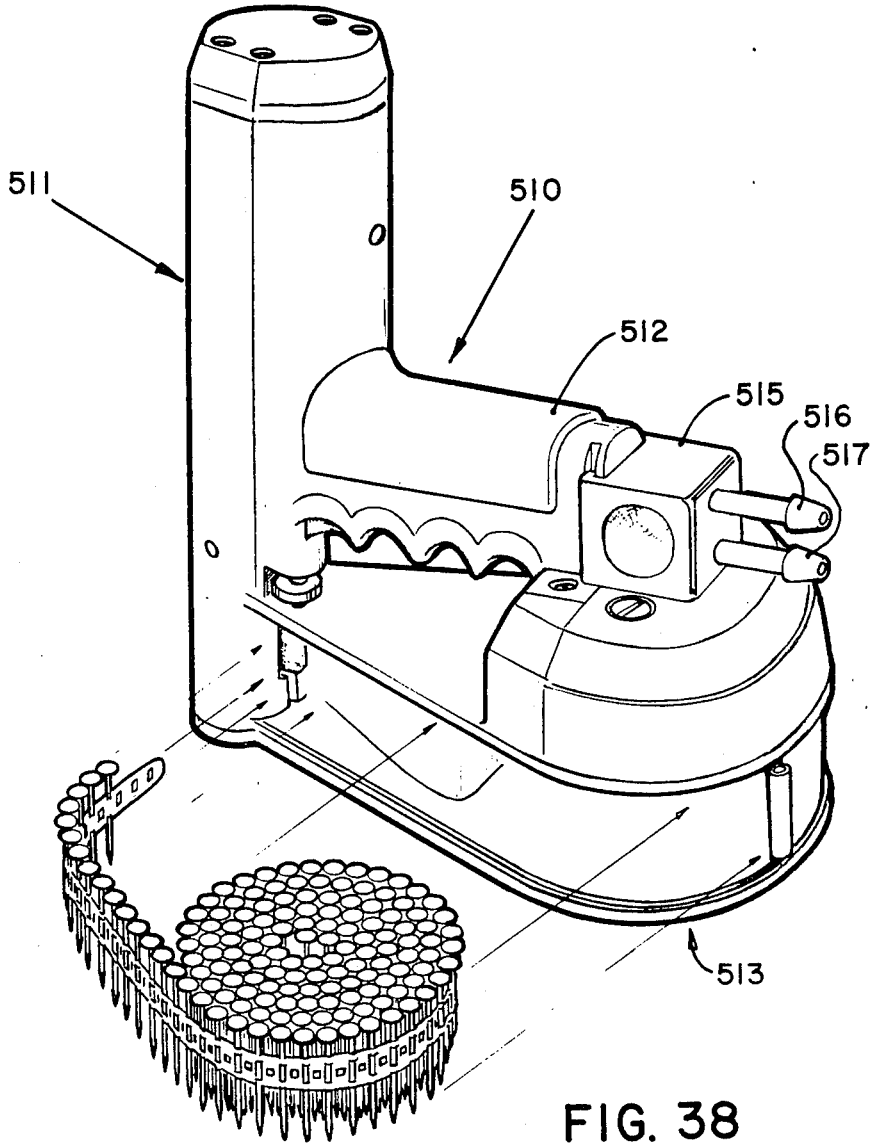
FIG. 38 is a perspective view of another embodiment of a nailing and dimpling apparatus according to the present invention.
Figure 39:
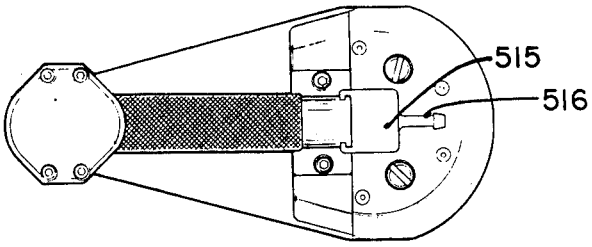
FIG. 39 is a top plan view of the embodiment of FIG. 38.
Figure 40:
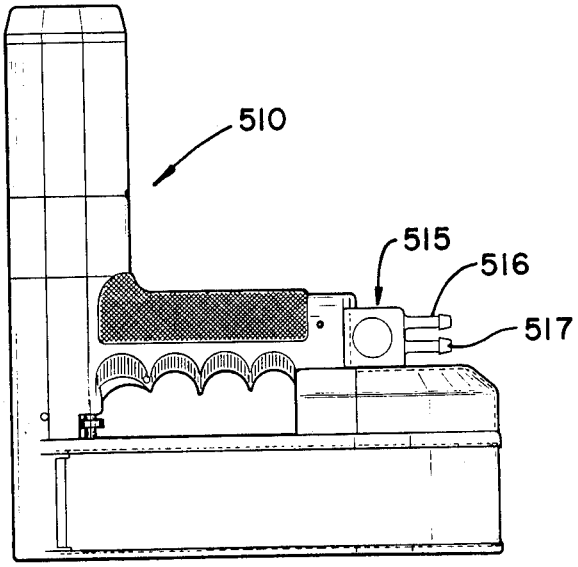
FIG. 40 is a side elevation view of FIG. 39.

Referring to FIGS. 38–40, there is provided in another embodiment of the present invention, a pneumatic nailing and dimpling apparatus designated generally as 510. In the apparatus 510 there is provided an elongated, generally cylindrical hammering section 511, a handle section 512, and a nail cartridge receiving section 513. At the rear end of the handle section 512 there is provided a compressed air and vacuum coupler 515. Coupler 515 is provided with a compressed air fitting 516 and a vacuum fitting 517.

Figure 41:
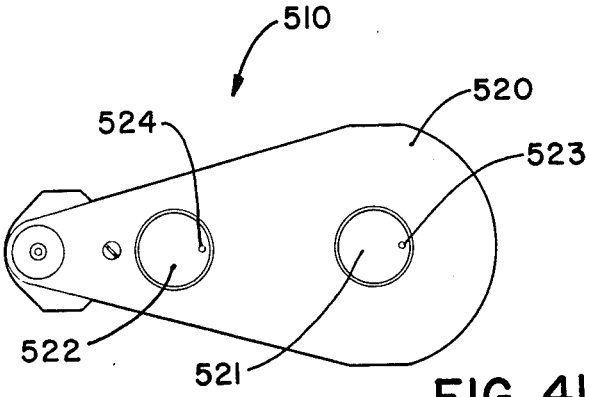
FIG. 41 is a bottom plan view of FIG. 40.

Referring to FIG. 41, the apparatus 510 is provided with a flat base 520. In the base 520 there is provided a plurality of circular recesses 521 and 522. In each of the recesses 521 and 522 there is provided a vacuum hole 523 and 524, respectively.

Figure 42:
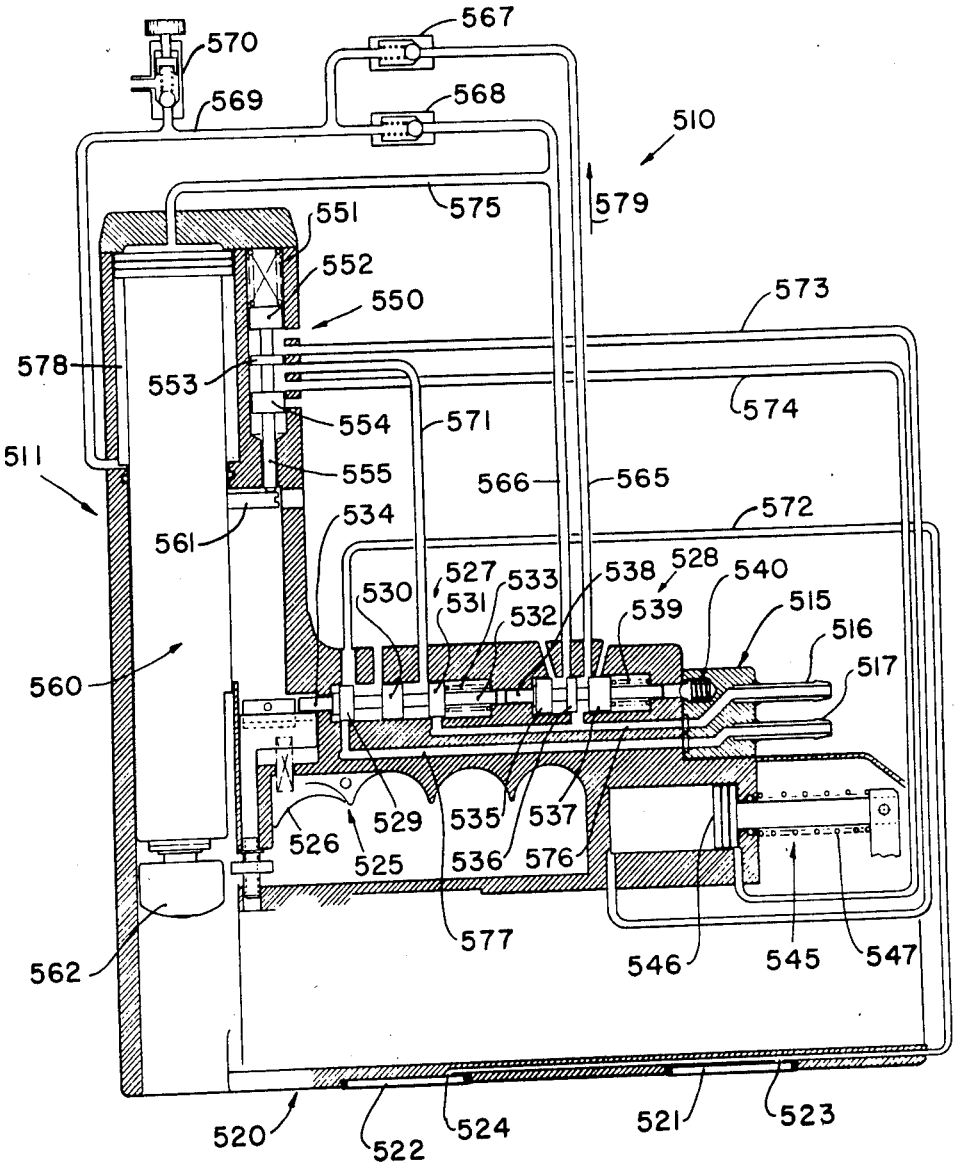
FIG. 42 is a diagrammatic view of air lines showing one stage of the operation of the apparatus of FIG. 38.

Referring to FIG. 42, there is provided in the handle section 512 of the apparatus 510 a trigger assembly 525 comprising a trigger member 526, a pair of valves 527 and 528. Valve 527 is provided with three valve members 529, 530 and 531, a stem 532 and a spring 533. Valve 528 is provided with three valve members 535, 536 and 537, a stem 538 and a spring 539.

In the coupler 515 there is provided a spring-biased ball snap 540. Snap 540 is provided for removably locking the coupler 515 to the rear end of the handle section 512. Below the fittings 516 and 517 there is provided a nail feed piston assembly 545. In the assembly 545 there is provided a piston 546 and a spring 547. The assembly 545 is coupled to a nail feed assembly, such as the assembly 270 described above with respect to FIG. 5A.

In the upper end of the hammering section 511 there is provided a switching valve assembly 550. In the assembly 550 there is provided a spring 551, three valve members 552, 553, 554 and a stem 555. To the left of the assembly 550 there is provided a hammering assembly 560. Extending outwardly from the assembly 560 there is provided a valve actuating pin 561. Extending from the bottom of the assembly 560 there is provided a dimple forming member 562. The assembly 550 and the assembly 560 are identical to the assemblies 245 and 232, respectively, described above with respect to FIG. 5A.

Extending from the valve 528 there is provided a pair of air passageways 565 and 566. In the air passageways 565 and 566 there is provided a pair of check valves 567 and 568. The check valves 567 and 568 are coupled in common to an air passageway 569. Air pressure in the air passageway 569 is controlled by an adjustable check valve 570.

Extending from the valve 527 to the valve 550 there is provided an air passageway 571. From the valve 527 to the holes 521 and 522 in the base 520 there is provided a vacuum line 572. Extending from the valve 550 to the nail feed piston assembly 545 there is provided a pair of air passageways 573 and 574. Extending from the air passageway 566 to the top of the hammer assembly 560 there is provided an air passageway 575. Extending from the fitting 516 to the valves 527 and 528 there is provided an air passageway 576. Extending from the fitting 517 to the valve 527 there is provided a vacuum line 577.

In operation, a source of compressed air is coupled to the fitting 516 and a source of vacuum is coupled to the fitting 517. Before the trigger member 526 and the trigger assembly 525 is depressed or pulled, compressed air flows through the passageway 576, through the valve 528 and the air passageway 565, through the check valve 567 and the air passageway 569 to the space provided therefor below the top of the hammering section 560 in the direction of the arrow 579. The air pressure in the space 578 raises the hammering assembly 560.

As the trigger member 526 is depressed, the valve 527 is moved to the right. As the valve 527 is moved to the right, the vacuum line 577 is coupled to the vacuum line 572 leading to the holes 521 and 522 in the baseplate 520. A vacuum created in the holes 521 and 522 creates a negative pressure between the base 520 and the wallboard or other surface against which the apparatus 510 is held, sucking the apparatus against the surface. At the same time, compressed air is routed through the air passageway 576 and the air passageway 571 to the valve 550 and from the valve 550 via the air passageway 574 to the rear of the piston 546 in the nail feed piston assembly 545. Compressed air at the rear of the piston 546 causes the piston 546 to be moved to its left, advancing the nail feed assembly as described above with the apparatus of FIG. 5A, placing a nail beneath the dimple forming member 562.

Figure 43:
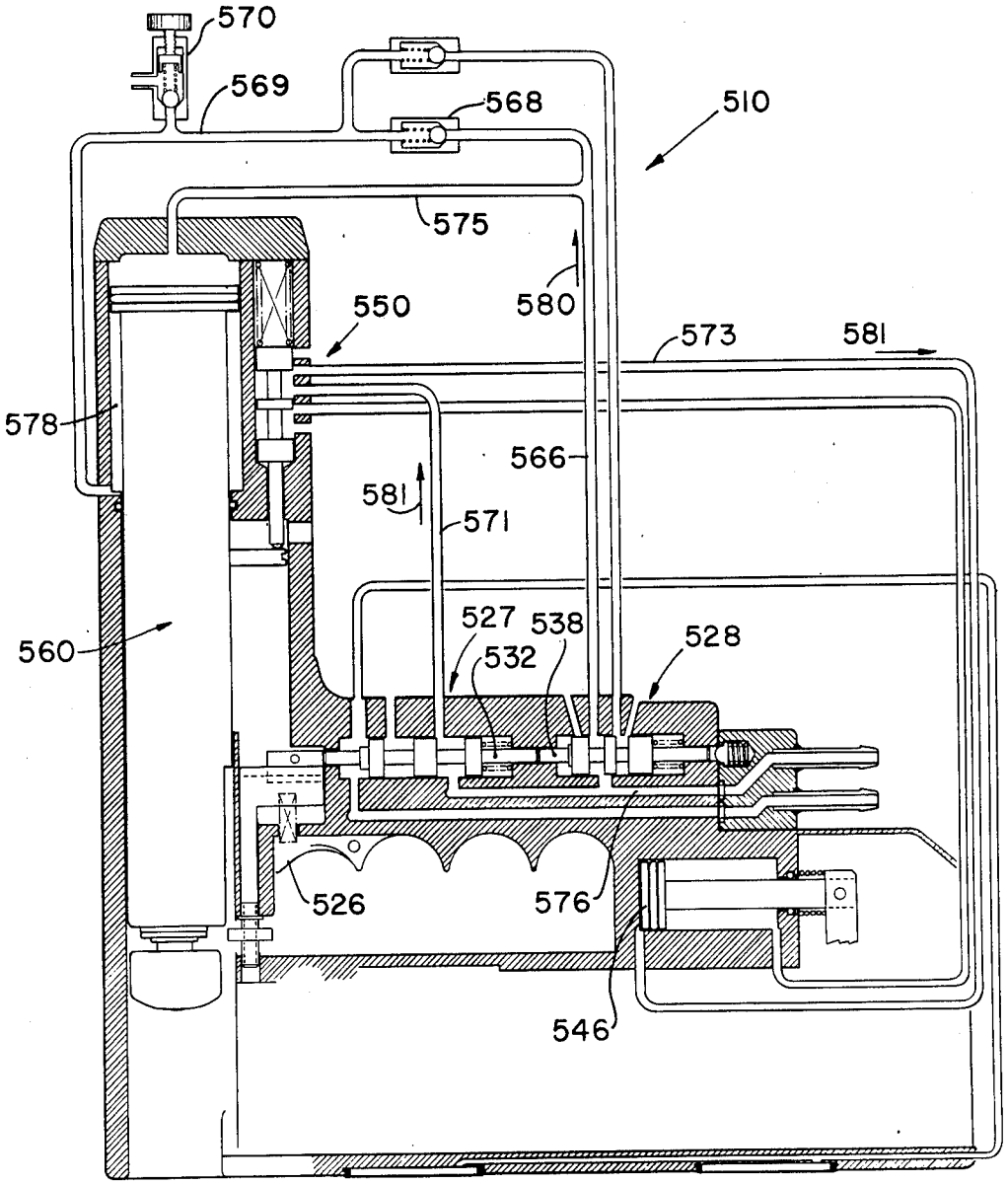
FIG. 43 is a diagrammatic view of air lines showing another stage of the operation of the apparatus of FIG. 38.

Referring to FIG. 43, as the trigger member 526 is further depressed, the stem 532 of the valve 527 contacts the stem 538 of the valve 528, moving the valve 528 to the right. As the valve 528 is moved to the right, compressed air in the passageway 576 is routed through air passageways 566 and 575 to the space above the hammer assembly 560, causing the hammer assembly 560 to be driven downwardly. The compressed air in the air passageway 566 is also routed through the check valve 568 and the air passageway 569 into the space 578 located below the top of the hammer assembly 560. The differential air pressure in the space above and below the top of the hammer assembly 560 is controlled by the adjustable check valve 570 so as to control the force and speed with which the hammer assembly 560 is driven downwardly.

As the hammer assembly 560 is driven downwardly, compressed air from the valve 527 flows through the air passageway 571, through the valve 550 and through the air passageway 573 in the direction of the arrow 581 to the front of the piston 546, causing the piston 546 to be moved to the right, retracting the nail feed assembly as described above with respect to the apparatus of FIG. 5A.

By eliminating the flexible hose 233 and the fitting 234 described above with respect to the apparatus of FIG. 5A, the compressed air from the passageway 575 is applied directly to the air passageway 448 described above with respect to FIG. 19A. At the same time, the elimination of the flexible hose 235, fitting 234 and 235 allows the length of the hammering section 511 to be shortened by an equivalent amount. Except as described above, the apparatus 510 is substantially identical to the apparatus 200 and for that reason, the features of each may be incorporated in the other.

Figure 44:
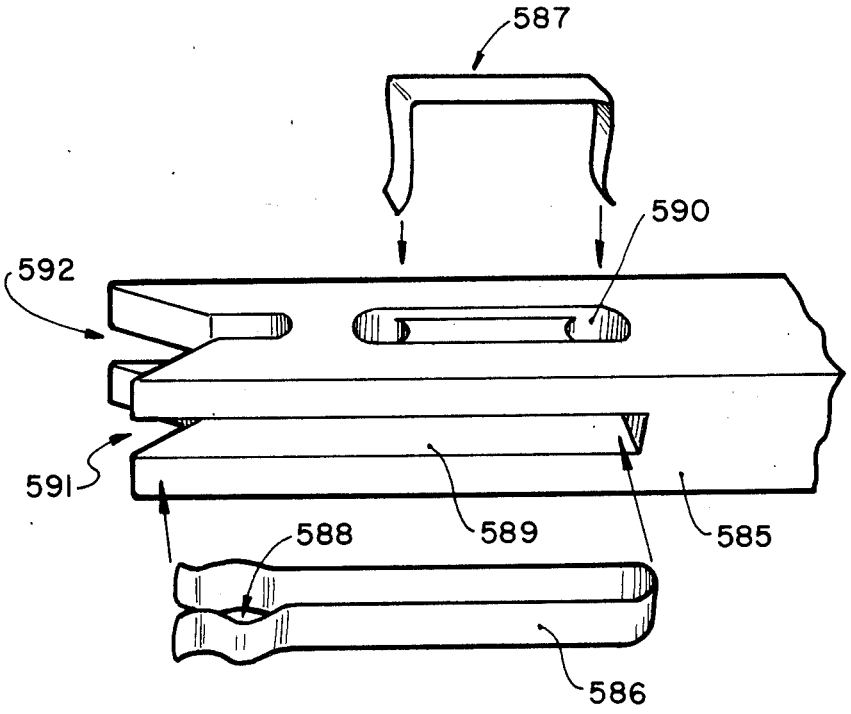
FIG. 44 is another embodiment of a lower feed arm in the nail feed assembly according to the present invention.

Referring to FIG. 44, there is provided in another embodiment of the present invention a lower nail feed arm 585. In the feed arm 585 there is provided a U-shaped spring member 586 and a U-shaped retaining clamp 587. The left or free ends of the arms of the spring member 586 are flared outwardly for receiving a nail in the space 588 provided therefor. In the feed arm 585 there is provided a slot 589 located between the upper and lower surfaces thereof for receiving the spring member 586 and a slot 590 in the center of the feed arm 585 for retaining the spring member 586 in the slot 589. The forward end of the feed arm 585 is provided with a pair of triangularly shaped slots 591 and 592 for guiding nails into the spring member 586. If desired, the apparatus of FIG. 44 can be used in any of the embodiments described above.

While several embodiment of the present invention are described, it is contemplated that various other modifications may be made thereto without departing from the spirit and scope thereof. Accordingly, it is intended that the embodiments described be considered only as illustrative of the present invention and that the scope thereof be determined by reference to the claims hereinafter provided.

What is claimed is:

1. An impact nailing and dimpling apparatus for setting a nail and a dimple in a surface of an exterior member comprising:

an elongated movable hammer assembly having a first and a second end and a means for setting a nail and providing a dimple in a surface of an exterior member attached to said first end thereof;

a piston means located within said hammer assembly for reciprocal movement therein between said first and second ends thereof;

valve means for selectively providing compressed air to said piston means in said hammer assembly to cause said piston means to move in said reciprocating fashion therein thereby moving said hammer assembly in such a manner so as to hammer said dimple providing means attached thereto into said surface of said exterior member as said nail is hammered therein; and dimple depth control means coupled to said valve means, said dimple depth control means being located in a position to be engaged and moved by said hammer assembly when said hammer assembly is moved by said piston means a predetermined distance corresponding to a predetermined dimple depth for causing said valve means to shut off compressed air flow to said piston means in said hammer assembly.

2. An apparatus according to claim 1 comprising means attached to said dimple depth control means for manually adjusting said predetermined dimple depth and wherein said dimple providing means attached to one end of said hammer assembly comprises:

a first surface, said first surface having a shape corresponding to the desired shape of said dimple; and a second recessed surface which is located in the center of said first surface for receiving the head of a nail, said recessed surface having a depth which corresponds to the thickness of said head of said nail.

3. An apparatus according to claim 2 wherein said adjusting means comprises a nut which is threadably attached to an elongated rod in said dimple depth control means and said first and said second surfaces are convex surfaces.

4. An apparatus according to claim 1 wherein said hammer assembly comprises a block located in said one end thereof, said block having a hole located therein and said dimple providing means comprises:

a bolt-shaped member which projects through said hole in said block, said bolt-shaped member having a flat head on one end thereof which is hammered by said piston means and means on its opposite end for attaching a dimple forming member thereto;

spring means located between said flat head and said block for resiliently decoupling the mass of said dimple providing means from the remainder of said hammer assembly; and a dimple forming member attached to said opposite end of said bolt-shaped member.

5. An apparatus according to claim 4 wherein said dimple forming member comprises:

a first surface having a shape corresponding to the desired shape of said dimple; and a second recessed surface which is located in the center of said first surface for receiving the head of a nail.

6. An apparatus according to claim 5 wherein said first and said second surfaces are convex surfaces.

7. An apparatus according to claim 1 wherein said valve means comprises a flutter valve means located in said second end of said hammer assembly and a plurality of air passageways for selectively directing said compressed air above and below said piston means so as to move said piston means in said reciprocating fashion within said hammer assembly.

8. An apparatus according to claim 1 comprising:

a movable nail feed assembly;

means coupling said nail feed assembly to said valve means for receiving compressed air from said valve means to extend and retract said nail feed assembly in a reciprocating fashion so that said nail feed assembly can remove nails from a cartridge of nails and place them one at a time in a position to be engaged by said dimple providing means in said hammer assembly.

9. An apparatus according to claim 1 comprising:

a base member having a planar surface; and means located in said base member which is coupled to a source of vacuum for providing a vacuum between said base member and said exterior member when said base member is placed against said exterior member.

10. An apparatus according to claim 9 wherein said means located in said base member comprises:

a recess; and means for forming a vacuum-tight seal between said recess and said exterior member.

11. An impact nailing and dimpling apparatus for setting a nail and a dimple in a surface of an exterior member comprising:

an elongated hammer assembly which is movable between a retracted position and an extended position, said hammer assembly including a dimple forming means attached to a first end thereof;

a nail feed assembly which is movable between a retracted position and an extended position;

a nail feed piston assembly connected to said nail feed assembly for retracting and extending said nail feed assembly, said nail feed piston assembly including a means for resiliently biasing said nail feed assembly to its retracted position;

a first valve means which is movable between a first position and a second position for selectively providing air from a source of compressed air to said hammer assembly;

means located in said first valve means for selectively providing air from said source to said hammer assembly to move said hammer assembly from its extended position to its retracted position when said first valve means is in its first position;

a second and a third valve means, each movable between a first and a second position for selectively providing air from a source of compressed air to said nail feed piston assembly;

means for moving said second valve means from its first position to its second position while said third valve means is in its first position;

means located in said second and said third valve means for providing air from said source to said nail feed piston assembly to move said nail feed assembly from its retracted position to its extended position when said second valve means is in its second position and said third valve means is in its first position for placing a nail from a cartridge of nails beneath said hammer assembly;

means for moving said first valve means from its first position to its second position;

means located in said first valve means for selectively providing air from said source to said hammer assembly to move said hammer assembly from its retracted position toward its extended position when said first valve means is in its second position;

means responsive to a movement of said hammer assembly from its retracted position toward its extended position for moving said third valve means from its first position to its second position;

means located in said third valve means for selectively providing air from said source to said nail feed piston assembly to move said nail feed assembly from its extended position to its retracted position when said third valve means is in its second position; and means coupled to said first and said second valve means which is located in a position to be contacted by said hammer assembly when said hammer assembly has been moved a predetermined distance from its retracted position toward its extended position for returning said first and said second valve means to their first positions.

12. An apparatus according to claim 11 wherein said dimple forming means comprises:

a first surface, said first surface having a shape corresponding to the desired shape of said dimple; and a second recessed surface which is located in the center of said first surfaoe for receiving the head of a nail.

13. An apparatus according to claim 12 wherein said first and said second surfaces are convex surfaces.

14. An apparatus according to claim 11 comprising a base having a planar surface for facilitating the setting of said nail in said exterior member perpendicular to the surface of said member.

15. An apparatus according to claim 11 comprising:

a base having a planar surface with a recess located therein;

means for coupling a source of vacuum to said second valve means; and means coupling said second valve means to said recess for providing a vacuum in said recess when said second valve means is moved from its first position to its second position.

16. An apparatus according to claim 15 comprising sealing means for forming a vacuum-tight seal between said base and exterior member against which said base is placed.

17. An apparatus according to claim 11 wherein said hammer assembly comprises:

a movable piston means; and flutter valve means which is responsive to compressed air from said first valve means for moving said piston means in a reciprocal fashion in said hammer assembly when said first valve means is in its second position.

18. An apparatus according to claim 11 wherein said hammer assembly comprises:

a piston means movable mounted for reciprocal movement therein:

a block located in said first end of said hammer assembly;

a bolt-shaped member which projects through a hole provided therefor in said block, said bolt-shaped member having a flat head on a first end thereof which is hammered by said piston means and means for attaching said dimple forming means to a second end thereof; and means located between said flat head of s bolt-shaped member and said block for resiliently decoupling the mass of said dimple forming means from the remainder of said hammer assembly.

19. An apparatus according to claim 18 wherein the dimple forming means comprises:

a first surface, said first surface having a shape corresponding to the desired shape of said dimple; and a second recessed surface which is located in the center of said first surface for receiving the head of a nail.

20. An apparatus according to claim 19 wherein said first and said second surfaces are convex surfaces.

21. An apparatus according to claim 11 wherein said nail feed assembly comprises:

a toothed sprocket member rotatably mounted on a cylindrical shaft, said sprocket member having a first and a second set of nail receiving recesses which are separated by a plurality of teeth members, said teeth members being provided for engaging a tape of tails;

an upper and a lower nail feed arm;

means for moving said upper and lower nail feed arms past said toothed sprocket member for removing nails from said tape;

means for advancing said lower nail feed arm beyond said upper nail feed arm after each of said nails is removed from said tape for placing said nail beneath said dimple forming means when said nail feed assembly is moved from its retracted position to its extended position; and sprocket advancing means for advancing said tape of nails to place another nail in position to be engaged by said upper and lower nail feed arms each time said nail feed assembly is moved from its extended position to its retracted position.

* * * * *

UNITED STATES PATENT AND TRADEMARK OFFICE

CERTIFICATE OF CORRECTION

PATENT NO. : 4,775,089

DATED : October 4, 1988

INVENTOR(S) : Donald K. MacDonald

It is certified that error appears in the above-identified patent and that said Letters Patent is hereby corrected as shown below:

Column 3, line 39, change "of" to --off--.
Column 4, line 29, change "FIGS." to --FIG.--.
Column 6, line 45, before "pair" insert --a--.
Column 7, line 2, before "provided" (first occurrence) delete "a"; line 47, before "provided" insert --is--.
Column 8, line 8, change "279" to --290--.
Column 9, line 11, change "325" to --275--.
Column 11, line 7, change "members" to --member--.
Column 14, line 31, change "FIGS." to --FIG.--.
Column 15, line 27, change "mail" to --nail--.
Column 22, line 13, change "movable" to --movably--; line 23, after "of" delete "s" and insert --said--.

Signed and Sealed this

Fourteenth Day of March, 1989

*Attest:*

DONALD J. QUIGG

*Attesting Officer*

*Commissioner of Patents and Trademarks*